US007155152B2

(12) United States Patent
Iwai et al.

(10) Patent No.: US 7,155,152 B2
(45) Date of Patent: Dec. 26, 2006

(54) METHOD OF IMAGE TRANSFER, METHOD OF AND APPARATUS FOR IMAGE FORMING

(75) Inventors: Sadayuki Iwai, Tokyo (JP); Tomoko Takahashi, Tokyo (JP); Ayako Iino, Tokyo (JP); Yoshinori Nakagawa, Tokyo (JP); Hideki Kosugi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/666,248

(22) Filed: Sep. 22, 2003

(65) Prior Publication Data

US 2004/0126148 A1 Jul. 1, 2004

(30) Foreign Application Priority Data

Sep. 20, 2002 (JP) ..... 2002-276313

(51) Int. Cl.
*G03G 15/16* (2006.01)

(52) U.S. Cl. ..... 399/296; 399/128

(58) Field of Classification Search ..... 399/66, 399/128, 296–303, 306, 308
See application file for complete search history.

(56) References Cited

U.S. PATENT DOCUMENTS

| | | | | |
|---|---|---|---|---|
| 4,162,843 | A | | 7/1979 | Inoue et al. |
| 4,348,098 | A | * | 9/1982 | Koizumi ..... 399/296 |
| 5,309,177 | A | | 5/1994 | Shoji et al. |
| 6,025,108 | A | * | 2/2000 | Hujii et al. |

FOREIGN PATENT DOCUMENTS

| | | | | |
|---|---|---|---|---|
| JP | 53-74037 | | | 7/1978 |
| JP | 59-192159 | | | 12/1984 |
| JP | 5-165383 | | | 7/1993 |
| JP | 08-030119 | | | 2/1996 |
| JP | 8-30119 | | | 2/1996 |
| JP | 9-146334 | | | 6/1997 |
| JP | 2002-023574 | A | | 1/2002 |
| JP | 2002023574 | A | * | 1/2002 |
| JP | 2002091252 | A | * | 3/2002 |
| JP | 2002-174934 | A | | 6/2002 |
| JP | 2002174934 | A | * | 6/2002 |

OTHER PUBLICATIONS

U.S. Appl. No. 11/370,057, filed Mar. 8, 2006, Yamada et al.
U.S. Appl. No. 11/370,823, filed Mar. 9, 2006, Nakagawa et al.
U.S. Appl. No. 11/376,434, filed Mar. 16, 2006, Takahashi et al.

* cited by examiner

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

A charge removing unit is provided in order to control the surface potential of an image bearing element by removing charge from a surface of the image bearing element before a toner image is transferred from the image bearing element to a transfer medium. Surface potential controlling units are provided upstream of a contact area between the image bearing element and the transfer medium in order to control the surface potential of the transfer medium so that a toner on the image bearing element does not shift to the transfer medium.

40 Claims, 20 Drawing Sheets

METHOD OF IMAGE TRANSFER, METHOD OF AND APPARATUS FOR IMAGE FORMING

BACKGROUND OF THE INVENTION

1) Field of the Invention

The present invention relates to an image transfer method that employs an electrostatic or electrophotographic imaging forming process.

2) Description of the Related Art

A large number of color documents being handled in the present-day offices demands fast-processing full color printers and copying machines more than ever before. A widely-used typical laser color printer employs what is known as a single drum method. In this method, plural developing devices, which contain developing devices for yellow (Y), magenta (M), cyan (C), and black (Bk), respectively, are arranged in close contact with a single photosensitive element. A toner image of each color is created on the photosensitive element each time the photosensitive element rotates. A full-color toner image is formed when the toner images are sequentially transferred from the photosensitive element to an intermediate transfer element or a recording medium.

There are two methods of transferring the toner images formed on the intermediate transfer element on to the recording medium. In one method, called the intermediate transfer method, the toner images of plural colors are superimposed on the intermediate transfer element, and then a combined color toner image is transferred on to the recording medium in one batch. In the other method, called the direct image transfer method, a color toner image is formed on the recording medium by sequentially transferring a toner image of each color from the photosensitive element to the recording medium. Of the two methods, the direct image transfer method has an advantage of a simple structure, and is cost-effective. In this method, however, when transferring an image by plural times, it is difficult to obtain a stable image forming because conditions such as a friction or an amount of contained moisture of the recording medium may vary. On the other hand, the intermediate transfer method has an advantage of stability of an image quality and handling of various kinds of recording medium because the superimposed image is transferred to the recording medium in one batch.

However, in either of the cases, the photosensitive element has to rotate four times in order to obtain a color image using the four colors, and as a result, the productivity cannot be increased. Therefore, in order to speed up the image forming process, as many photosensitive elements as the number of colors (normally three or four) are provided with their respective developing devices arranged in close contact with corresponding photosensitive elements. A color image is obtained on the recording medium by contacting recording medium from one photosensitive element to another. This method is called the tandem method or the inline method. For example, in Japanese Patent Laid-Open Publication No. S53-74037 (Corresponding U.S. Pat. No. 4,162,843), an image forming apparatus is disclosed in which plural photosensitive elements are provided for speeding up the image forming process in which a transfer sheet is conveyed on a belt-type conveying unit in order to form toner images sequentially on the transfer sheet.

In this case, if the circumferential speed of the photosensitive elements is the same as for a single drum method, a four times higher printing speed can be achieved compared to the single drum method. However, if direct image transfer method described above, in which the toner image is directly transferred from the photosensitive elements to the recording medium, is carried out, there may arise some instability in recording medium transfer or positional deviation in recording medium conveyance. Therefore, a proposal for using what is called a tandem intermediate transfer method, which employs a tandem type intermediate transfer element, is disclosed in Japanese Patent Laid-Open Publication No. S59-192159.

Among recent full-color image forming apparatuses, the most prevalent is a single drum type machine or a tandem type machine that uses an intermediate transfer element, particularly an intermediate transfer belt. However, there are drawbacks of a color image forming method in which the toner images are transferred by plural times on to the intermediate transfer element.

For instance, in a full-color image forming apparatus comprising photosensitive elements, a primary charging device, an image exposing device, developing devices, and four image forming units for the four color toners of cyan, magenta, yellow, and black, and a transfer unit, when transferring images from the third color, the toner that has already been transferred to the intermediate transfer element may be transferred back to the photosensitive element, which is called a reverse transfer.

If the reverse transfer of toner occurs, when recycling spent toner from the cleaner of the photosensitive element at the developing device, it leads to a mixing of different color toners in the developing device. The mixing of colors in the developing device can pose a serious problem when multi-color image formation is involved. Further, the reverse transfer can disrupt the toner image on the intermediate transfer element and eventually lead to a deterioration of image quality.

To cope with the problem, a proposal was disclosed in Japanese Patent Laid-Open Publication No. H9-146334, that the angle of the latent image bearing element with respect to water should be 85° or greater. However, this solution has not sufficiently solved the problem.

According to a study made by the inventors of the present invention, the reverse transfer of the toner from the intermediate transfer element to the photosensitive element mainly takes place in a non-image portion of the photosensitive element because of potential difference.

According to the test conditions of the inventors, the non-image portion of the photosensitive element has an electric potential of −550 volts. In contrast, the electric potential of an image portion where the toner had been developed has a potential difference of about −150 volts and 400 volts. The voltage on the surface of the intermediate transfer element was around +500 volts. The potential difference between the image portion and the surface of the intermediate transfer element in the vicinity of the transfer nip is about 650 volts. In contrast, the potential difference between the non-image portion and the surface of the intermediate transfer element is as large as 1050 volts due to a transfer bias required for transferring the toner image to the intermediate transfer element, leading to discharge of the potential between the non-image portion and the surface of the intermediate transfer element in and around the transfer nip or charge injection into the toner. This discharge of the potential or the charge injection is considered to be a main cause of the reverse transfer. It has been proved that the potential difference between the intermediate transfer element and the surface of the photosensitive element contributed largely to the reverse transfer.

In Japanese Patent Laid-Open Publication No. H5-165383, a proposal to reduce reverse transfer of the non-image portion is disclosed in which a reduction of the reverse transfer is achieved by reducing the potential difference in the image portion and the non-image portion by removing a charge on the surface of the photosensitive element before the transfer nip. FIG. 23A and FIG. 23B illustrate a result of the experiment by the inventors of the present invention, which was carried out to demonstrate the effect on the image of the pre-transfer charge removal by light irradiation; FIG. 23A is an image obtained with the pre-transfer charge removal, and FIG. 23B is an image obtained without the pre-transfer charge removal.

The images in FIG. 23A and FIG. 23B show the effect of the pre-transfer charge removal on clarity of image. This effect appears because of the so-called toner scattering. Toner scattering is caused when the surface of the photosensitive element is exposed to light to remove charge prior to the transfer of the toner image on to the intermediate transfer element and the potential difference between the image portion and the non-image portion is canceled out. This causes the toner image to have charged particles of the same polarity which makes them electrostatically repel each other and scatter before the conveyance of the toner to the intermediate transfer element. Normally, the toner scattering is suppressed because of a higher potential of the non-image portion with respect to the image portion on the photosensitive element. However, charge removal diminishes the suppression effect on the toner scattering.

The inventors of the present invention invented a method for preventing the toner scattering and the reverse transfer. The method removes charge on the photosensitive element by exposing to light the area where the photosensitive element comes in contact with the intermediate transfer element. This method is an innovative method for suppressing the toner scattering and preventing the reverse transfer. However, the method necessitates a use of light-permeable material in the intermediate transfer element, increasing the material-related constraints and thereby making the implementation complicated.

SUMMARY OF THE INVENTION

It is an object of the present invention to solve at least the problems in the conventional technology.

The image transfer method according to one aspect of the present invention includes neutralizing a surface potential of an image bearing element that carries a toner image, controlling a surface potential of a transfer medium so that toner is not transferred from the image bearing element to the transfer medium at an upstream of a contact area between the image bearing element and the transfer medium, and transferring a plurality of toner images of different colors from the image bearing element repeatedly to the transfer medium to form a superposed toner image on the transfer medium.

The image transfer method according to another aspect of the present invention includes neutralizing a surface potential of each of a plurality of image bearing elements that carry toner images made from toners of different colors, controlling a surface potential of a transfer medium so that the toners are not transferred from the image bearing element to the transfer medium at an upstream of a contact area between the image bearing element and the transfer medium, and transferring the toner images from the image bearing elements to the transfer medium to form a superposed toner image on the transfer medium.

The image forming method according to still another aspect of the present invention includes forming an electrostatic latent image on an image bearing element, forming a toner image from the electrostatic latent image using toner, neutralizing a surface potential of the image bearing element that carries the toner image, controlling a surface potential of a transfer medium so that the toner is not transferred from the image bearing element to the transfer medium at an upstream of a contact area between the image bearing element and the transfer medium, and transferring a plurality of toner images of different colors from the image bearing element repeatedly to the transfer medium to form a superposed toner image on the transfer medium.

The image forming method according to still another aspect of the present invention includes forming electrostatic latent images on a plurality of image bearing elements, forming toner images from the electrostatic latent images using toners of different colors, neutralizing a surface potential of each of the image bearing elements that carry the toner images, controlling a surface potential of a transfer medium so that the toners are not transferred from the image bearing elements to the transfer medium at an upstream of a contact area between the image bearing elements and the transfer medium, and transferring the toner images from the image bearing elements to the transfer medium to form a superposed toner image on the transfer medium.

The image forming apparatus according to still another aspect of the present invention includes an image bearing element, a latent image forming unit that forms an electrostatic latent image on the image bearing element, a developing unit that develops the electrostatic latent image to form a toner image on the image bearing element using toner, a transfer unit that transfers the toner image on to a transfer medium, wherein the transfer unit transfers a plurality of toner images of different colors from the image bearing element repeatedly to the transfer medium to form a superposed toner image on the transfer medium, a neutralizing unit that, when the toner image is transferred, neutralizes a surface potential of the image bearing unit, and a control unit that controls a surface potential of the transfer medium so that the toner is not transferred from the image bearing element to the transfer medium at an upstream of a contact area between the image bearing element and the transfer medium.

The image forming apparatus according to still another aspect of the present invention includes a plurality of image bearing elements, a plurality of latent image forming units that form electrostatic latent images on the image bearing elements, a plurality of developing units that develop the electrostatic latent images to form toner images on the image bearing elements using toners of different colors, a transfer unit that transfers the toner images on to a transfer medium, wherein the transfer unit transfers the toner images of different colors from the image bearing elements repeatedly to the transfer medium to form a superposed toner image on the transfer medium, a neutralizing unit that, when the toner image is transferred, neutralizes a surface potential of the image bearing unit, and a control unit that controls a surface potential of the transfer medium so that the toner is not transferred from the image bearing element to the transfer medium at an upstream of a contact area between the image bearing element and the transfer medium.

The other objects, features and advantages of the present invention are specifically set forth in or will become apparent from the following detailed descriptions of the invention when read in conjunction with the accompanying drawings.

BRIEF DESCRIPTION OF THE DRAWINGS

FIG. 23A is an image obtained with the pre-transfer charge removal, and FIG. 23B is an image obtained without the pre-transfer charge removal.

DETAILED DESCRIPTIONS

Exemplary embodiments of a method image transfer, a method of and apparatus for image forming apparatus are explained in detail with reference to the accompanying drawings.

Figure 1:
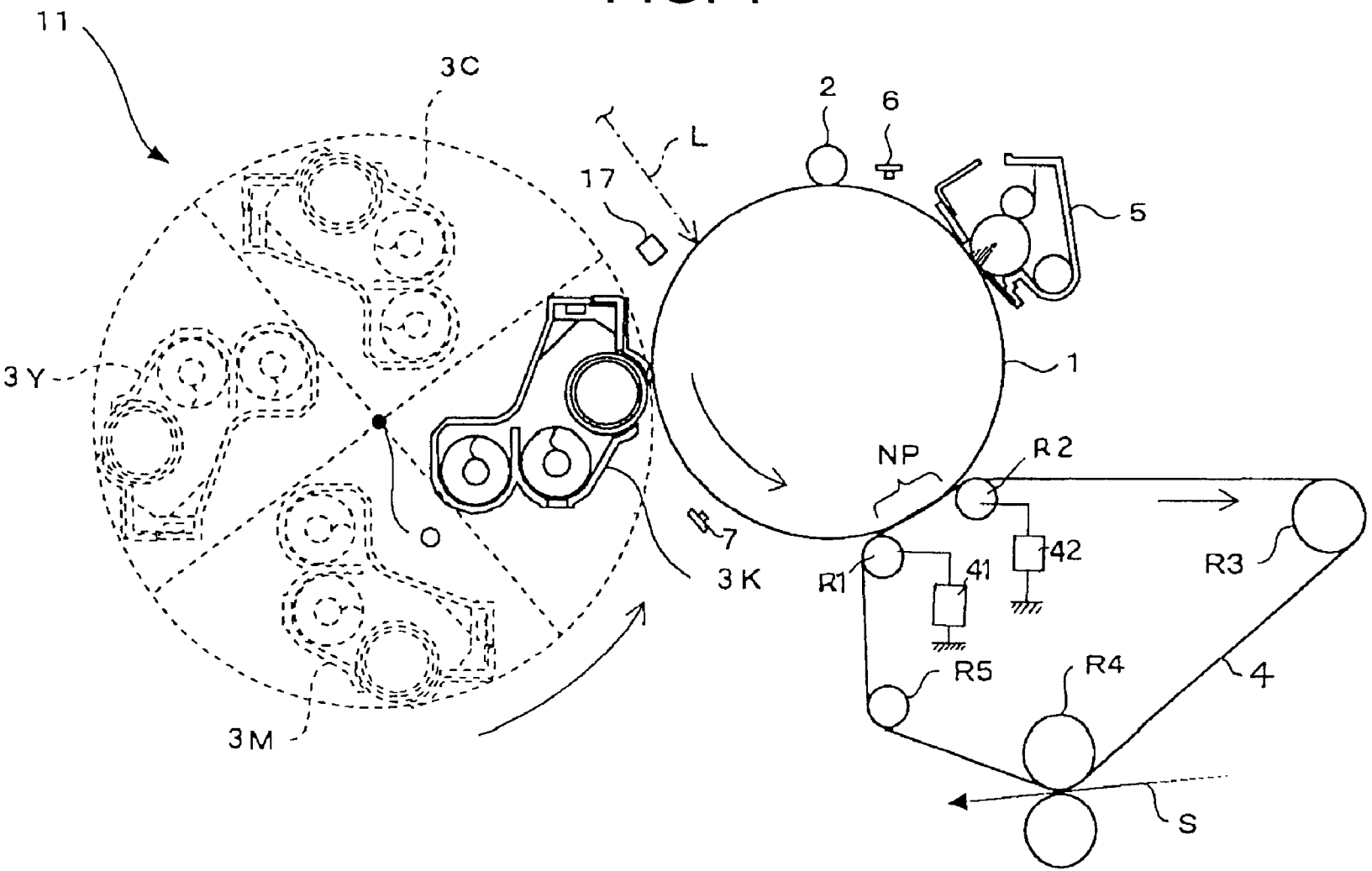
FIG. 1 is a schematic diagram of an image forming apparatus according to a first embodiment of the present invention.

The present invention relates to an image forming apparatus that, for instance, as shown in FIG. 1, comprises an image bearing element 1 that carries an electrostatic latent image, a latent image forming unit (scanning unit) L that forms the electrostatic latent image on the image bearing element 1, a developing unit 11 (including 3K, 3M, 3Y, and 3C) that develops the electrostatic latent image on the image bearing element 1 by charged color particles (toner) and forms toner images on the image bearing element 1, and transfer unit R2, 42 that transfers the toner images on the image bearing element 1 on to a transfer medium 4. The image forming apparatus with a structure as described above forms an image by first forming a toner image on the image bearing element 1 and then transfers this toner image on to the transfer medium 4 plural times to form an image on the transfer medium 4 by superposing the plural color toner images. The image forming apparatus according to the present invention can have a structure which is explained with reference to FIG. 20 through FIG. 23. According to this structure, the image forming apparatus comprises plural image carrying bodies 1K, 1Y, 1M, and 1C that each carry an electrostatic latent image, a latent image forming unit (image writing section) 13 that forms the electrostatic latent image in each of the image carrying bodies 1K, 1Y, 1M, and 1C, a developing means 3 that develops the electrostatic latent images on each of the image carrying bodies 1K, 1Y, 1M, and 1C by respective toners, and a transfer unit 9 that transfers the toner images on the image carrying bodies 1K, 1Y, 1M, and 1C on to a transfer medium 4. The image forming apparatus with a structure as described above forms an image by forming a toner image of a predetermined color on each of the image carrying bodies 1K, 1Y, 1M, and 1C and then transfers the toner images on to the transfer medium 4 to form an image on the transfer medium 4 by superposing the plural color toner images. The present invention relates more particularly to a new image transfer method by which toner scattering and deterioration of image due to a reverse transfer of toner can be prevented. In this image transfer method an image is formed using an intermediate transfer element as the transfer medium 4 by repeatedly transferring toner images from a single or plural image carrying bodies on to the intermediate transfer element 4 and superposing the plural color toner images on the intermediate transfer element 4. The present invention further relates to an image formation method by which an excellent image can be reproduced by preventing reverse transfer using the aforementioned image transfer method. The image transfer method and the image forming method according to the present invention are explained next. The structure of the image forming apparatus will be explained later.

The inventors of the present invention made an observation that when transferring a toner image formed on the image bearing element (a photoconductive photosensitive element, for instance) by the charged color particles of the toner on to the transfer medium (an intermediate transfer element, for instance), a so-called transfer scattering occurred mainly in the vicinity of the upstream inlet of the transfer nip. The main reason for this transfer scattering, as the inventors discovered, was what is called a pre-transfer phenomenon in which the toner flows towards the intermediate transfer element from the photosensitive element before the intermediate transfer element and the photosensitive element come in contact causing the toner to scatter. The driving force with which the toner scatters during pre-transfer the electrostatic force, which pulls the toner towards the surface of the intermediate transfer element, that comes into play when the surface potential of the intermediate transfer element has a positive absolute value with respect to the surface potential of the photosensitive element when the toner is negatively charged and the surface of the photosensitive element is also negatively charged. Normally, if a positive bias voltage with respect to the photosensitive element is impressed on the intermediate transfer element in order to facilitate a normal toner transfer at the transfer nip. However, heavy transfer scattering occurs if the positive bias voltage also acts on the surface of the intermediate transfer element at the transfer nip inlet portion. To avoid this problem, the inventors of the present invention have offered a method, called a counter-bias image transfer method, for preventing transfer scattering. To implement this counter-bias image transfer method, a structure that includes a belt-type intermediate transfer element that is suspended by two rollers with respect to the photosensitive element is used. The suspension roller on the nip inlet end is given a negative bias and the suspension roller on the nip outlet end is given a positive bias. The electric field at the nip inlet is set such that the orientation of the electric field of the toner movement at the nip inlet is towards the photosensitive element end instead of towards the intermediate transfer element end, thereby preventing transfer scatter. The inventors discovered that because pre-transfer at the transfer nip inlet portion, which is the main cause of transfer scattering, can be prevented, transfer scattering does not occur even if the charge is removed on the surface of the photosensitive element.

To summarize, the inventors of the present invention have invented an image transfer method (claims 1 through 3) by which reverse transfer is prevented by removal of charge on the surface of the photosensitive element and the transfer scattering is prevented by the counter-bias image transfer method, and an image forming method (claims 4 through 6) employing this image transfer method.

Figure 2:
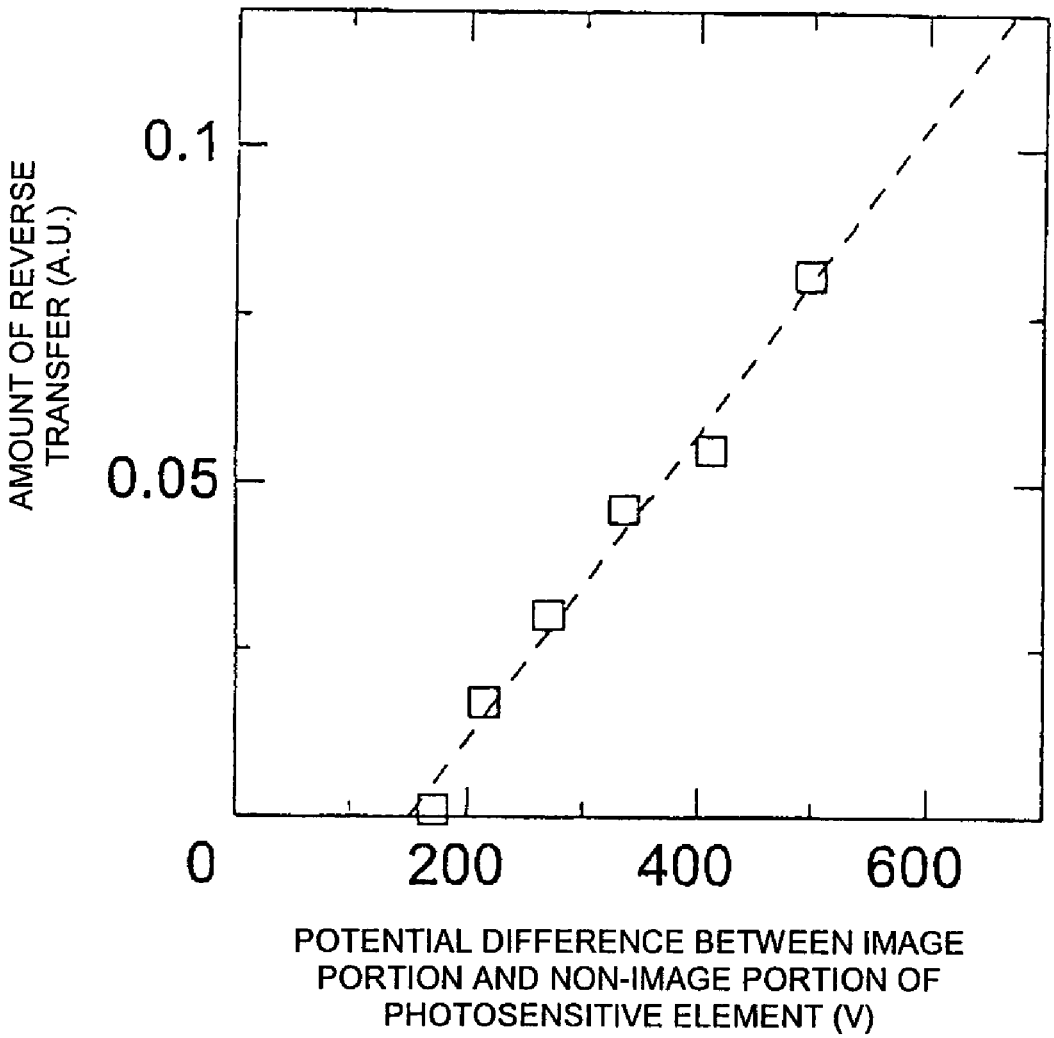
FIG. 2 is a graph of a relation between surface potentials of an image portion and a non-image portion on a photosensitive element and the amount of a toner in a reverse transfer.

FIG. 2 is a graph that illustrates the relation between surface potential of an image portion and a non-image portion on the photosensitive element and the amount of the toner in reverse transfer. The horizontal axis represents the surface potential difference (absolute value) between the image portion and the non-image portion at the transfer nip portion where the photosensitive element and the intermediate transfer element are in close contact. The vertical axis represents the amount of toner that is reverse-transferred to the photosensitive element.

It is evident from the graph in FIG. 2 that the amount of reverse-transferred toner can be suppressed by suppressing the absolute value of the surface potential difference of the photosensitive element. It can be concluded from the result of this experiment that reverse transfer can be prevented by ideally keeping the surface potential difference between the image portion and the non-image portion of the photosensitive element at 200V or less, and thereby a good image can be obtained.

However, if the charge is removed only from the non-image portion, the electric field that secures the toner image to the photosensitive element is discharged, causing toner scattering even before image transfer.

Figure 3A:
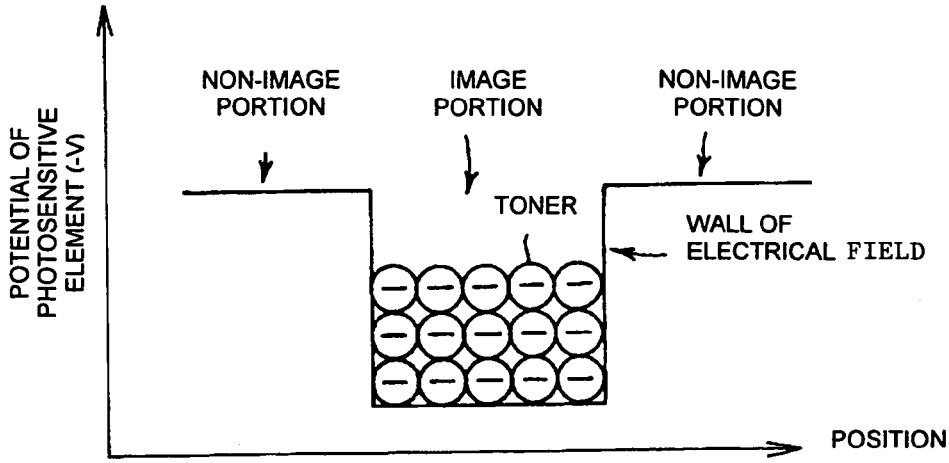
FIG. 3A and FIG. 3B illustrate a relation between potential differences of an image portion and a non-image portion on a photosensitive element and a toner scattering.
Figure 3B:
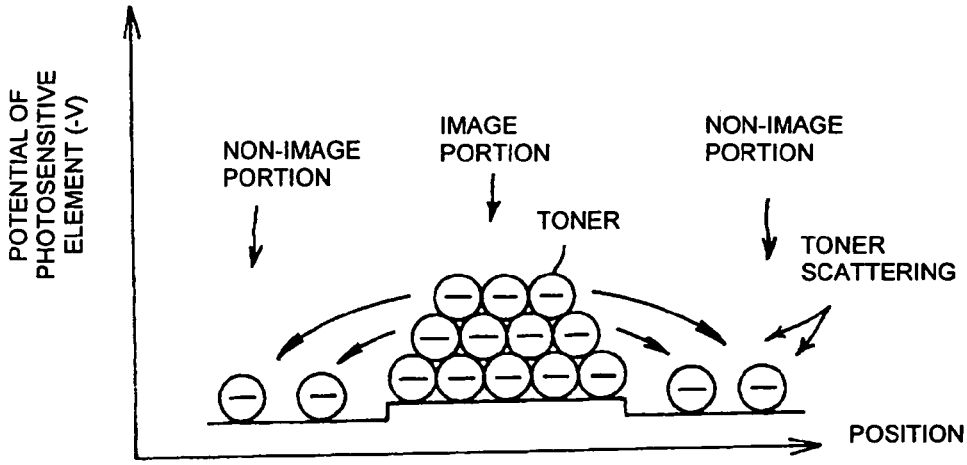

FIG. 3A and FIG. 3B are drawings illustrating the relation between the potential difference of an image portion and a non-image portion on a photosensitive element and toner scattering. FIG. 3A illustrates the case when the potential difference between the image portion and the non-image portion is large. FIG. 3B illustrates the case when the potential difference between the image portion and the non-image portion is small. When the potential difference between the image portion and the non-image portion is large, the toner particles of the image portion are restrained by the electric field barrier. Hence toner scattering is prevented. However, when the potential difference between the image portion and the non-image portion is small, the non-image portion has a lower potential than the image portion. This causes the toner particles of the image portion to scatter to the non-image portion resulting in toner scattering.

Therefore, the potentials of the image portion and the non-image portion should preferably be kept either approximately the same, or if absolute values are compared, the potential of the non-image portion should be kept large.

In the experiment condition shown in FIG. 3A and FIG. 3B, the surface potential of the photosensitive element in the image portion is approximately −150 and the graph is obtained by changing the potential of the non-image portion of the photosensitive element by optically removing the charge.

The most effective way to remove charge on the surface of the photosensitive element is to expose the surface to light. This method involves a simple unit which is space-saving (claim 7).

Figure 4:
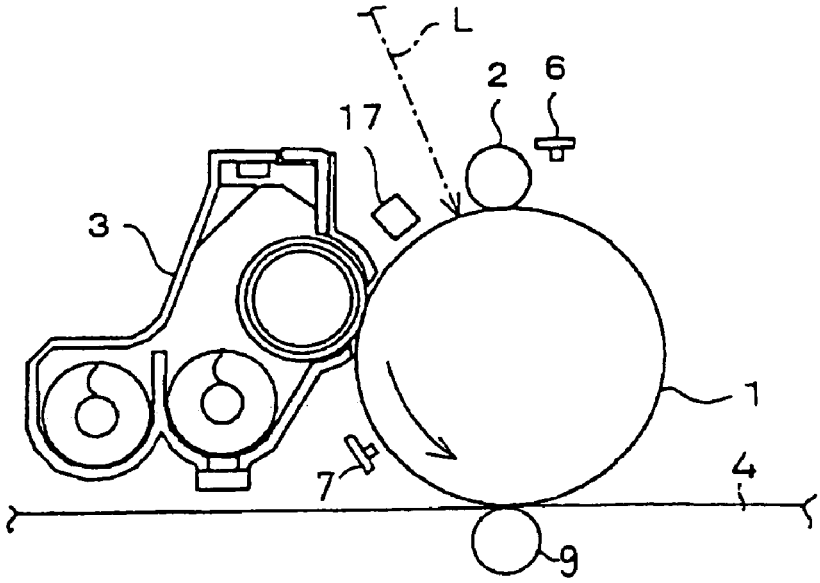
FIG. 4 is a schematic diagram of an example of a charge removing unit that carries out pre-transfer removal of charge on a surface of the photosensitive element by a light exposure.

FIG. 4 is a schematic diagram of an example of a charge removing unit that carries out pre-transfer optical removal of charge on the surface of a photosensitive element. The reference numeral 1 represents a drum-type photosensitive element. The other parts in the direction of the arrow in FIG. 4 are a charging roller 2, an erase lamp 17, a developing device 3, a charge removing unit 7, an intermediate transfer element 4, a not shown cleaning means, a charge remover 6, etc. The photosensitive element 1 disposed between the charging roller 2 and the developing device 3 is exposed by a scanning light L emitted from a not shown exposing unit. The portion where the photosensitive element 1 is in contact with the intermediate transfer element 4 is called a transfer nip portion. The pre-transfer charge removing unit 7 is disposed against the surface of the photosensitive element 1 between the developing device 3 and the transfer nip portion.

The image forming process is explained next in brief. The surface of the photosensitive element 1 is charged uniformly by the charging roller 2. An electrostatic latent image is then formed on the photosensitive element 1 by the scanning light L. This latent image is developed by the toner in the developing device 3 to form a toner image. The toner image is then transferred on to the intermediate transfer element 4. Pre-transfer charge removal is carried out on the surface of the photosensitive element.

To optically remove charge on the surface of the photosensitive element 1, a light emitting diode (LED), semiconductor laser device (LD), or xenon lamp may be used as the charge removing unit 7.

The surface potential of the photosensitive element 1 can be controlled by controlling the removed electrical charges, which in turn can be controlled by the adjusting the amount of emitted (exposure) light, which can be influenced by the current flowing through or the voltage impressed on the light emitting device and the semiconductor laser device (claim 8). As shown in FIG. 2, reverse transfer can be prevented by keeping the potential difference between the image portion and the non-image portion of the photosensitive element low. However, if the amount of light is increased to a great extent in order to achieve this, the photosensitive element may develop light fatigue and its life will be remarkably shortened. For this reason it is necessary to set the amount of light required for optical removal of charge to an appropriate range.

Some photosensitive elements are more easily prone to light fatigue and for such photosensitive elements exposure to any light other than the scanning light is best avoided as far as possible. There is a method for such photosensitive elements, in which optical removal of charge on the photosensitive element is carried out by ions emitted by an ion emitting device on the portions of high surface potential on the photosensitive element (claim 9).

Figure 5:
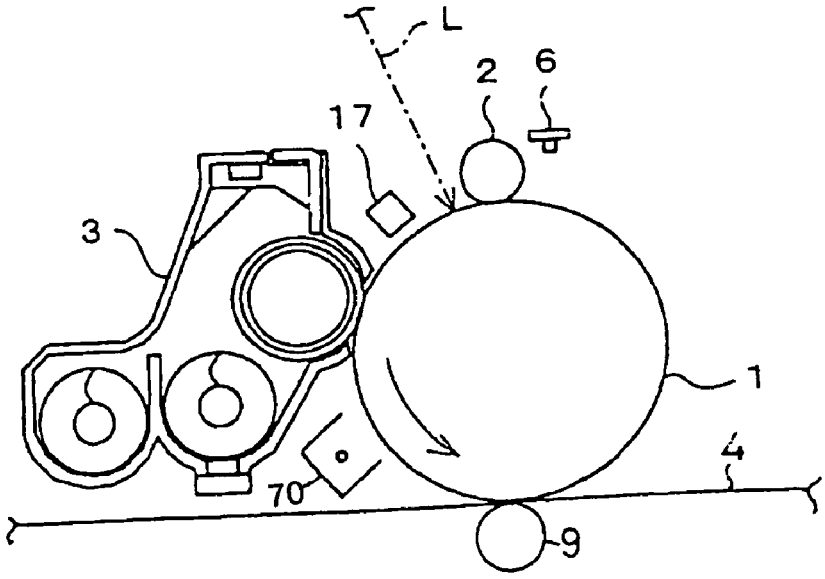
FIG. 5 is a schematic diagram of an example of a charge removing unit that carries out pre-transfer removal of charge on the surface of the photosensitive element by an ion radiation.

FIG. 5 is a schematic diagram of an example of a charge removing unit that carries out pre-transfer removal of charge the current on the surface of the photosensitive element by ion radiation.

For instance, as a pre-transfer charge-removing unit, an ion emitting device 70 such as a corotron, etc. is disposed facing the surface of the photosensitive element 1 between the developing device 3 and the transfer nip portion. An AC bias is impressed on the ion emitting device by which positive and negative ions are produced. The charge is removed by directing the positive ions to the non-image portion. In this method, charge removal occurs due to the emitted ions selectively adhering to the non-image portion since it has a higher potential with respect to the image portion on which toner is affixed. Further, charge removal in the non-image portion can be accomplished by generating ions of opposite polarity to that of the toner using a corotron, etc. by setting the grid unit of the same polarity as the potential of the toner-affixed image portion and slightly increasing the absolute value (claim 10).

It is preferable to carry out these charge removing steps before the developing step in which the electrostatic latent image on the photosensitive element is developed by the toner in the developing device, and the image transfer step in which the toner image on the photosensitive element is transferred on to the intermediate transfer element. Occurrence of reverse transfer can be avoided by keeping the potential of the non-image portion low. However, for a blotch-free good developing to take place the contrast between the potentials of the image portion and the non-image portion should be large. Hence, by carrying out charge removal after the developing step, both good developing and reverse transfer prevention can be accomplished (claim 11).

Figure 6:
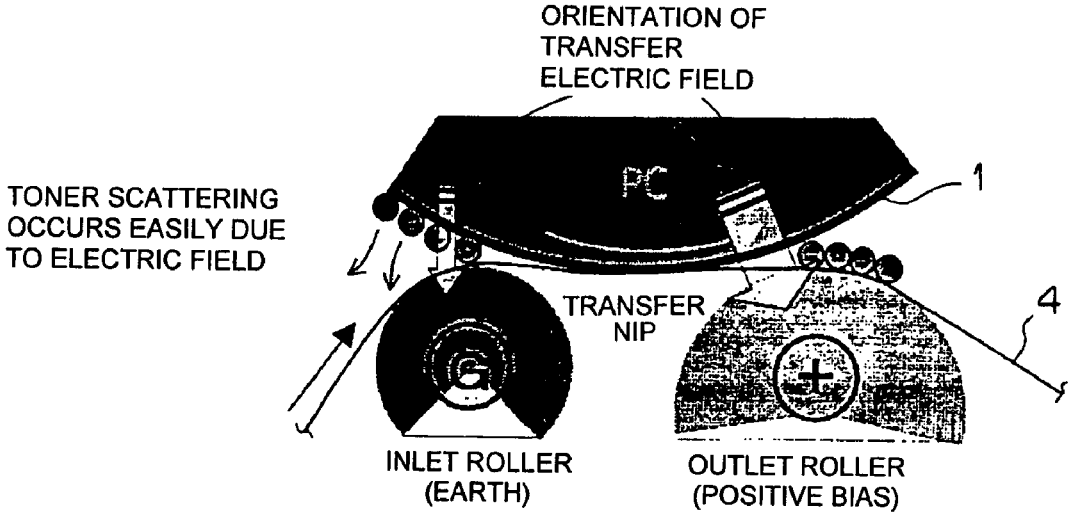
FIG. 6 is a schematic diagram illustrating the orientation of the electric field in the vicinity of a transfer nip inlet in a conventional image forming method.
Figure 7:
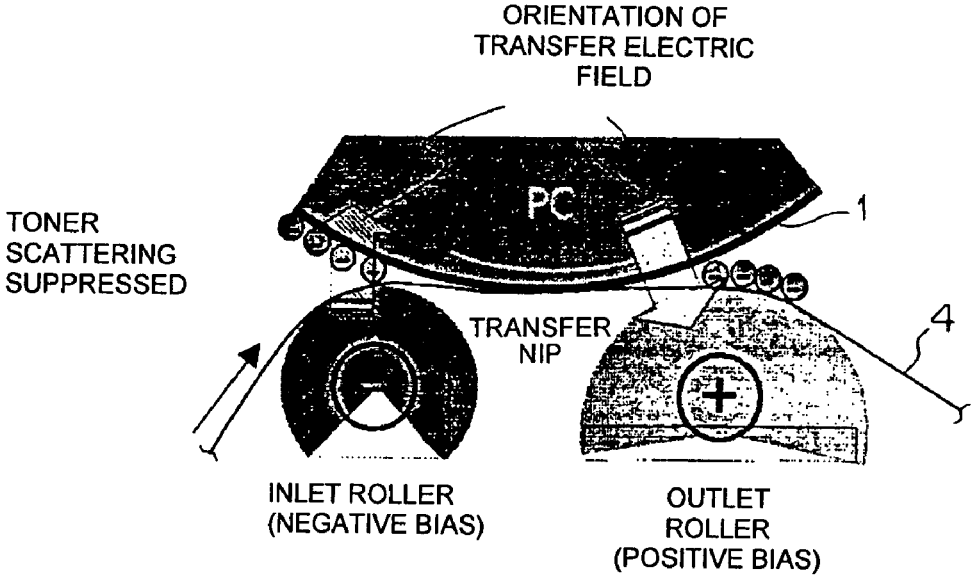
FIG. 7 is a schematic diagram illustrating the orientation of the electric field in the vicinity of a transfer nip inlet in an image forming method according to the present invention.
Figure 8:
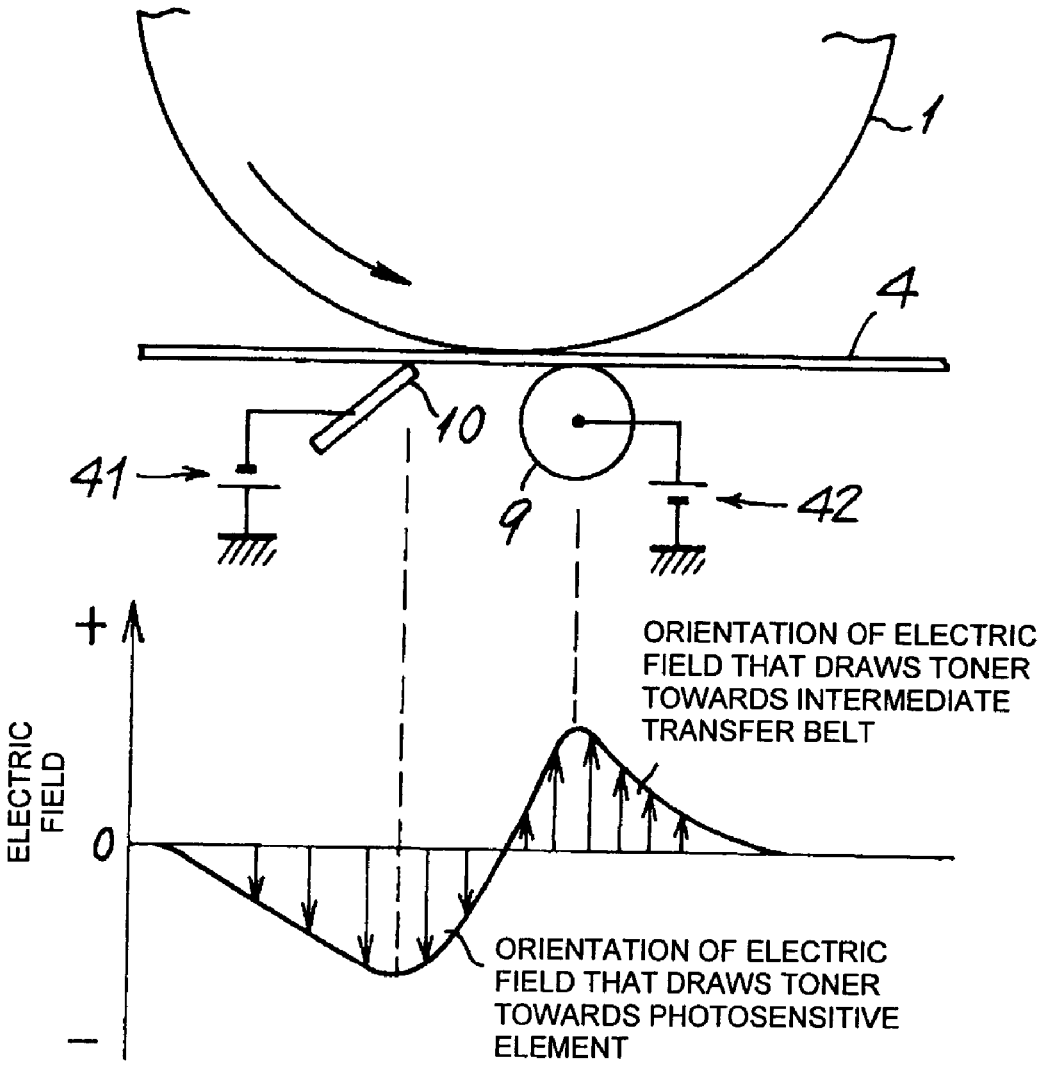
FIG. 8 is a schematic diagram illustrating a change in the orientation of the electric field while passing through the transfer nip in the image forming method according to the present invention.

A method for suppressing a pre-transfer scattering that occurs at the transfer nip inlet is explained next with reference to FIG. 6 through FIG. 8. FIG. 6 illustrates the orientation of the electric field in the vicinity of a conventional transfer nip inlet. FIG. 7 illustrates the orientation of the electric field in the vicinity of the transfer nip inlet in which a counter-bias method is employed. FIG. 8 illustrates the change in the orientation of the electric field during passage through the transfer nip.

In a system employing reverse development, when the toner charge polarity is negative, the photosensitive element 1 also has a negative charge potential. The potential in the image portion that is recorded as a latent image by exposure to the light beam does not entirely disappear, there being residual potential in the range of −50 volts to −70 volts.

When the toner having a negative polarity develops this image portion, the potential of the image portion after development becomes −150 volts to −250 volts (depending on the charge amount and weight of the toner used for developing). On the other hand, the surface potential of the intermediate transfer element 4 in the vicinity of the transfer nip inlet, while depending also on the system, is 0 volts when the conditions are good and around +500 volts when the conditions are not good, due to a leak in the positive polarity bias impressed for image transfer. The electric field that results due to the relation between the potential of the image portion on the photosensitive element 1 and the surface potential of the intermediate transfer element 4 is such that it makes the toner move from the photosensitive element 2 to the intermediate transfer element 3. It is due to this electric field that the pre-transfer toner scattering occurs. Therefore, this toner scattering can be prevented, by reversing the direction of the electric field, if the surface potential of the intermediate transfer element before the transfer nip can be kept lower than the potential of the image portion on the photosensitive element 1. This is the basic principle behind the counter-bias image transfer method (claim 12).

The method for controlling the surface potential of the intermediate transfer element 4 can be broadly classified into the following two. The first method of control is to directly apply the potential to the surface of the intermediate transfer element 4 using some means (claim 13). The second method of control is to charge the surface of the intermediate transfer element 4 to a predetermined level before the transfer nip is approached (claim 17).

A method of the first type is explained next with reference to FIG. 7. An intermediate transfer belt is used as an intermediate transfer element 4. A driven roller R1 of a conductive element is disposed near the back of the transfer nip inlet and in contract with the intermediate transfer belt. A bias can be impressed on the roller R1 which is passed to the surface of the intermediate transfer belt (claim 14). This method is simple and does not cause impairment to the back of the intermediate transfer belt because the roller R1 is a driven type. However, the diameter of the roller R1 cannot be reduced beyond a certain extent and therefore space requirement for accommodating the roller R1 will pose a problem. Another drawback is to take care that the roller R1 does not interfere with a conductive element R2 (for instance, an image transfer bias roller) provided for applying image transfer bias and disposed near the transfer nip outlet.

Therefore, a plate-type conductive material 10 of 0.1 millimeters to 0.5 millimeters thickness made of a stainless steel (SUS) plate (preferably with its front end rounded with a file so as to avoid damage to the belt) is used as a counter-bias blade to which a counter-bias is impressed from the bias current source 41. This method also yields the same result. A conductive rubber or a conductive resin plate may be used instead of the steel plate (claim 15).

The plate element can be used right up to the end of the transfer nip portion and therefore yields a better result. Further, it is cost-effective and space-saving.

Apart from metal, raw material for conductive rubber or resin can be polyurethane, polyurea, silicon, NBR, CR, fluorine rubber, fluorine, fluorinated resin, polycarbonate, nylon, polypropylene, polyethylene, etc. Carbon or ground metal can be incorporated into these materials as a conductive filler so as to render the material conductive. Alternatively, the raw material such as epichlorohydrin rubber, etc., itself may possess ion conductivity. It is preferable that the plate element is made of a material which had a good mechanical strength and a low coefficient of friction since the plate element will always be rubbing against the intermediate transfer belt 4. Alternatively, it is desirable to reduce the friction in the contact portion.

In spite of reduction of friction in the contact portion, there is a possibility that the belt may wear out due to constant rubbing of the plate against the belt and with the passage of time. Another method which involves a softer contact and is space-conserving is the use of a conductive brush (item 110 in FIG. 21*b*, claim 16). However, this method also has a drawback in that the bristles may come off. All the methods mentioned above have their merits and demerits and may be employed as the situation demands.

Figure 9:
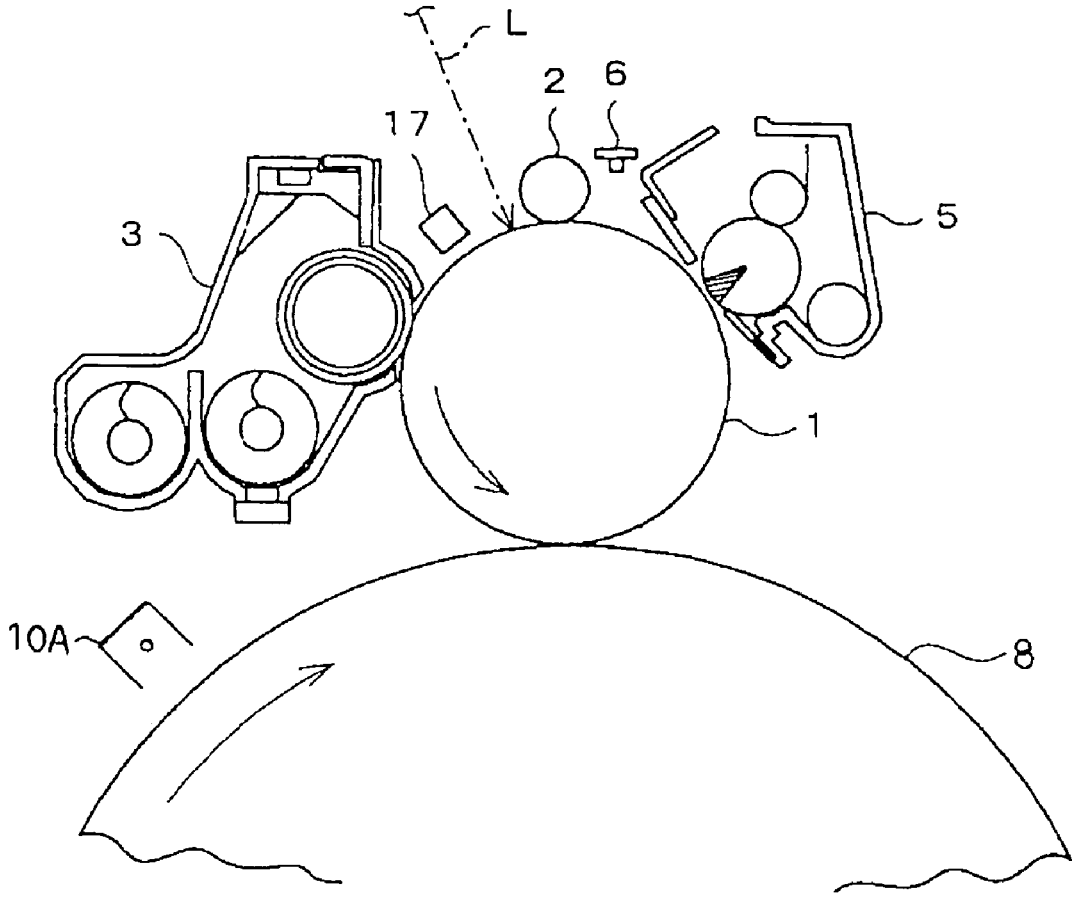
FIG. 9 is a schematic diagram of an example of a charging unit that charges the surface of the intermediate transfer element before passing through the transfer nip portion.
Figure 10:
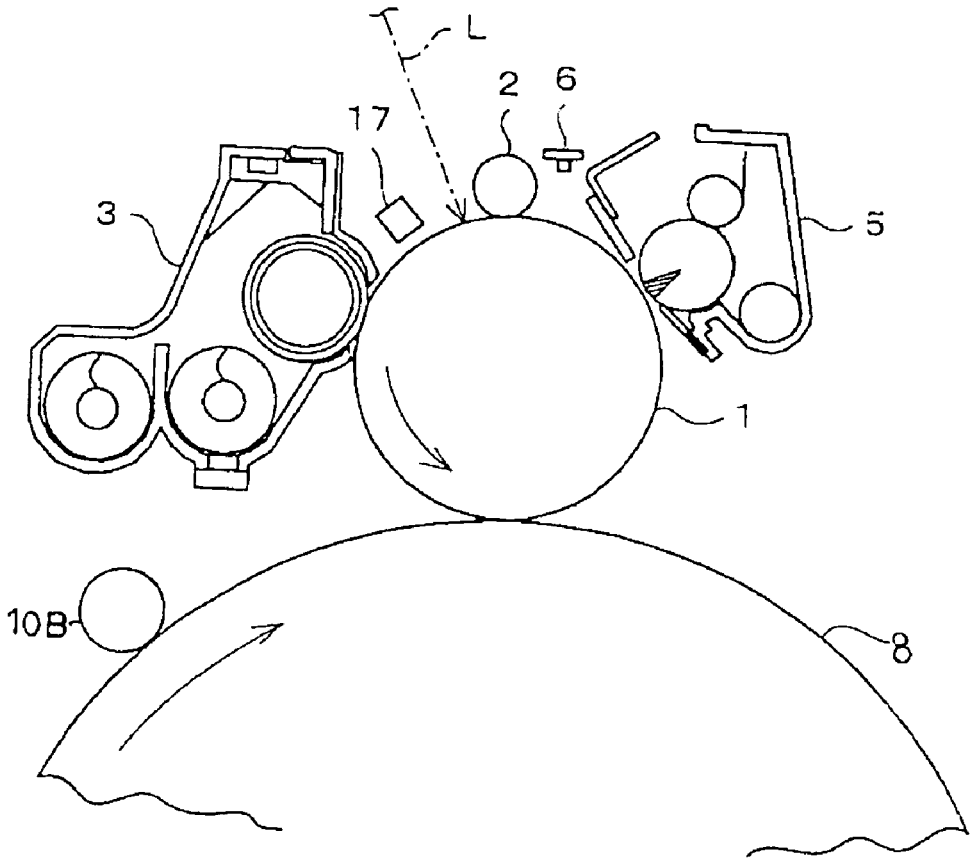
FIG. 10 is a schematic diagram of another example of a charging unit that charges the surface of the intermediate transfer element before passing through the transfer nip portion.
Figure 11:
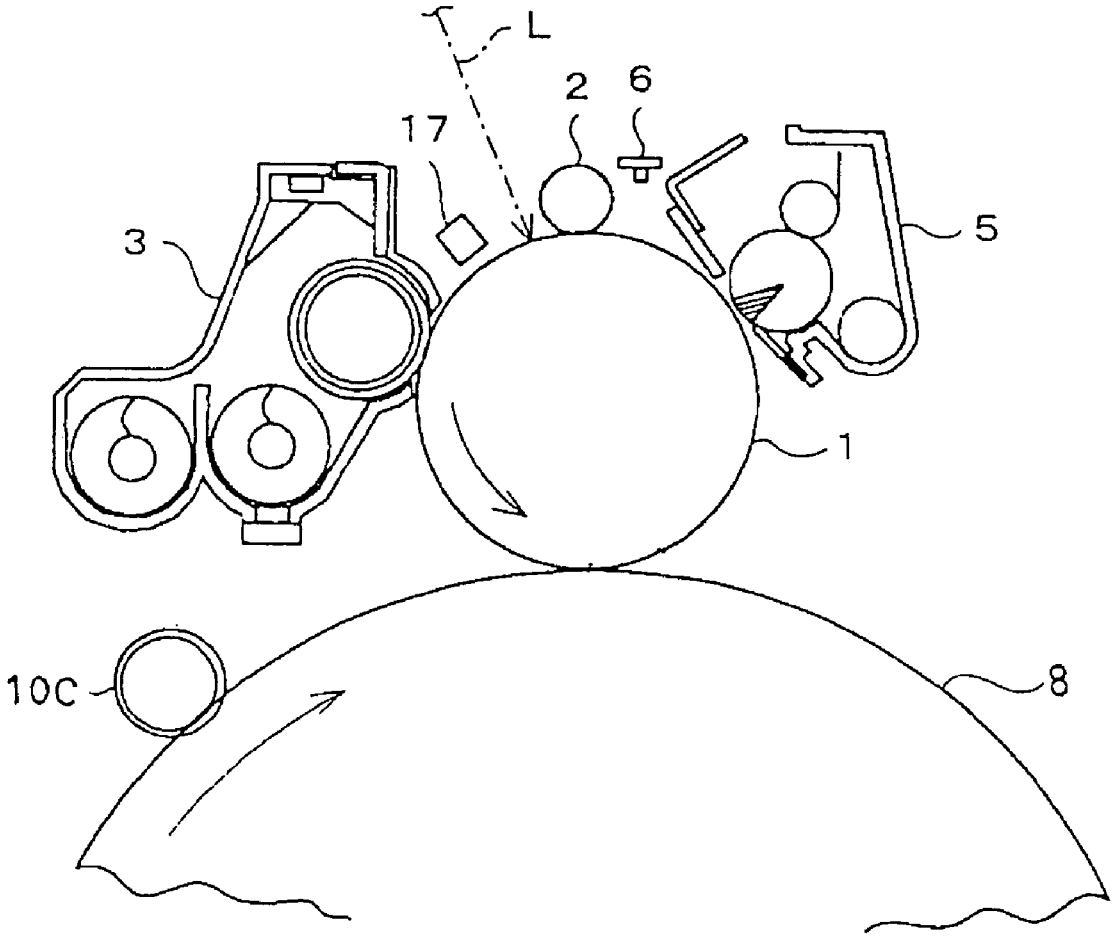
FIG. 11 is a schematic diagram of yet another example of a charging unit that charges the surface of the intermediate transfer element before passing through the transfer nip portion.

A method of charging the intermediate transfer element is explained next with reference to FIG. 9 through FIG. 11. In FIG. 9 through FIG. 11 an intermediate transfer drum 8 is used as an intermediate transfer element.

FIG. 9 illustrates an example of a method in which the surface of the intermediate transfer element 8 is charged with a charging device 10A such as a corona charger before the intermediate transfer element 8 approaches the transfer nip (claim 18). It is desirable to adjust the potential to a specific value using a scorotron. However, in recent years charging devices are being abandoned due to their propensity to produce ozone. As an alternative to a charger, a roller charging element 10B (a contact charging roller) is used, as shown in FIG. 10 (claim 19). In this case, the surface of the intermediate transfer element 8 is charged so that it has a negative polarity. Therefore, the bias impressed on the contact charging roller 10B is also of a negative polarity. Since the toner is also of a negative polarity, there is no concern over the toner sticking to the contact charging roller 10B. However, even though there is no risk of toner sticking electrostatically, if there occurs a difference in the linear velocities between the contact charging roller 10B and the intermediate transfer element 8, the image may be corrupted no matter what.

Therefore, another example is provided, as illustrated in FIG. 11, in which a conductive element 10C (for instance a non-contact charging roller) is disposed slightly apart from the intermediate transfer element 8 and a voltage is impressed on the non-contact charging roller (claim 20).

In the example shown in FIG. 11, a NC roller that is applied as a photosensitive charging device of a Ricoh color printer (Ipsio Color8000) was employed. This roller has a SUS metal core with a cladding of a conductive NBR (of a volume resistance of $1\times10^7$ Ωcm). At the end of the roller a gap tape is wound to a thickness of 50 μm in order that there is a gap between the roller and the intermediate transfer element 8. Charging of the charge-receiving intermediate transfer element 8 is carried using the non-contact method by applying a bias by pressing the tape portion against the intermediate transfer element 8. In this method, charging can be carried out without the charging element coming in contact the toner-containing intermediate transfer element 8 during color imaging.

The methods explained with reference to FIG. 9 through FIG. 11 have their merits and demerits and may be employed as the situation demands.

The present invention offers various devices and means in color imaging by which reverse transfer is prevented while maintaining a scatter-free condition in an image which is transferred from a photosensitive element to an intermediate transfer element. Among the color images, there are cases in which a certain color is not used. This implies that there is no image transferred from the photosensitive element and therefore no possibility of scattering. It is possible to set conditions, according to the information of the image formed on the photosensitive element, which prevent reverse transfer by setting either all or individual process conditions different from normal conditions. For instance, it is preferable to keep the potential non-image portion of the photosensitive element as close to 0 volts as possible. If an image is present, the potential of the non-image portion can be reduced only up to −150 volts to −250 volts. However, if an image is not present, it will be easier to prevent reverse transfer by more strongly the charge on the photosensitive element. Hence, it is preferable to control the amount of charge removed on the photosensitive element according to the information of the image formed on the photosensitive element (claim 21).

Reverse transfer practically cannot occur if the surface potential of the intermediate transfer element before the transfer nip inlet is on the positive side as compared with the potential of the photosensitive element. Consequently, it would be effective to change, depending on the information of the image formed on the photosensitive element, the potential from the usual negative value to 0 volts or a slightly positive value (claim 22). Since transfer bias, if given more than what is required, can cause reverse transfer, it would be effective to change to a lower value (claim 23).

During a color image formation, there is no risk of reverse transfer when the first color is transferred to the intermediate transfer element. In this case, all efforts can be made towards suppression of transfer scattering since reverse transfer is out of the picture, contrary to the claims 21 through 23. Therefore, since transfer scattering is least when charge is removed on the photosensitive element, it would most effective to transfer the first color to the intermediate transfer element without removing the charge on the photosensitive element (claim 24)

In recent years, in view of improved transfer and image quality, there is a preference for toners having particles that have a high degree of roundness. Further, it has been discovered by the inventors of the present invention that reverse transfer can be prevented if a toner has an average degree of roundness of 0.94 or greater.

Figure 12A:
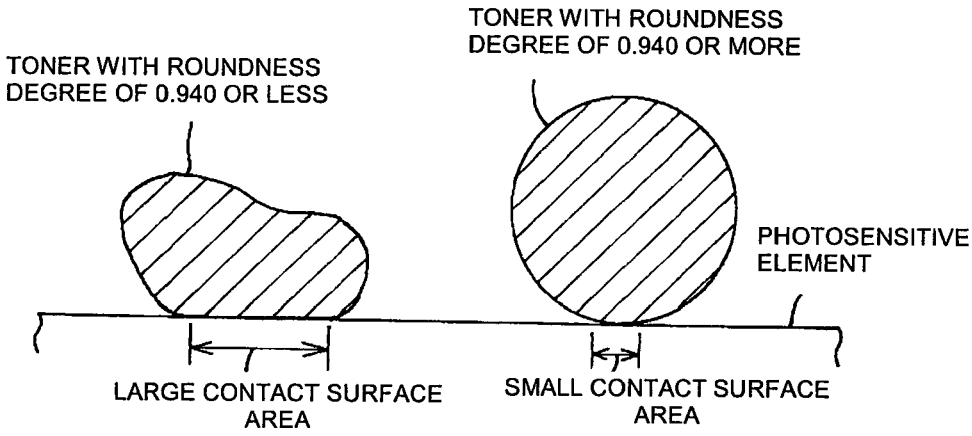
FIG. 12A and FIG. 12B are schematic diagrams illustrating a relation of between a shape of toner and attachment strength of the toner to the photosensitive element.
Figure 12B:
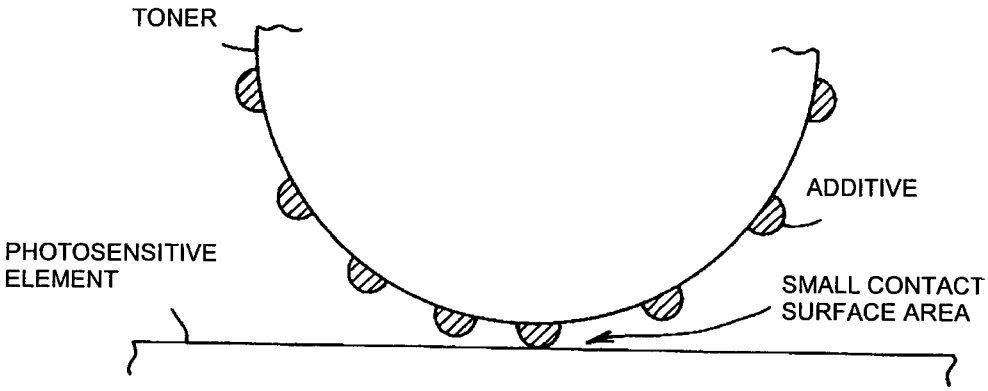

FIG. 12A and FIG. 12B illustrate the relation of the shape of a toner to the attachment strength of the toner to a photosensitive element. In FIG. 12A, the attachment strength of the toner with a degree of roundness of over 0.94 is less because the contact area with the photosensitive element is less. In FIG. 12B, the attachment strength of the toner with a degree of roundness of over 0.94 is less because the diameter of the particles of the external additives of the toner is even smaller (making the contact area with the photosensitive element smaller than the contact area of the of the toner particle). Hence, it is evident that the transfer rate improves and reverse transfer is prevented if the attachment strength to the photosensitive element is less. The result of measured reverse transfer rate under normal conditions using toners of varying degrees of roundness is given in Table 1 below.

TABLE 1 degree of roundness and reserve transfer rate of toner

| Sample | Degree of roundness | Reserve transfer rate |
|---|---|---|
| Toner non-processed | 0.919 | 8% |
| Toner processed 1 | 0.932 | 7% |
| Toner processed 2 | 0.945 | 3% |
| Toner processed 3 | 0.960 | 3% |
| Toner processed 4 | 0.976 | 2% |

The degree of roundness of the toner can be determined by observing a random sample of toner particles under a scanning electron microscope or an optical microscope and analyzing the shape of the sample toner particles either by a commercially available image analyzer or a flow-type particle image analyzer such as FPIA-1000 manufactured by Sysmex. An image analyzer is an apparatus that renders the imaging of the toner particles in the toner and carries out image analysis and particle size analysis. The degree of roundness is determined as:

$$\text{Degree of roundness}=\Sigma[(4\pi Si/Li^2)]/N \quad (1)$$

where Li is the circumference of each particle in the projected image, Si is the projected surface area of each particle, and N is the total number of particles under observation. The degree of roundness increases as it approaches one.

A toner that has an average degree of roundness of not less than 0.94 is better able to resist reverse transfer. This is due to the fact that adhesive force between the toner to the photosensitive element contributes largely towards reverse transfer, and the more spherical the toner particle, the less the van der Wall's forces between the toner and the photosensitive element.

Van der Wall's force generally decreases as the contact surface area with the opposing surface (the photosensitive element, in this case) reduces. Consequently, as shown in FIG. 12, as the toner particle gets closer to a sphere, the contact surface area of the toner particle reduces. As a result, the mobility of the toner increases while its adhesive property decreases. Due to this, the probability of external additives of the toner, such as silica or titanium oxide, coming in contact with the photosensitive element increases. Since the diameter of the particles of these external additives is much less compared to the diameter of the toner particle, the van der Wall's force decreases.

The column 'relation between the degree of roundness of toner and reverse transferability' shows the ranking of toners having different average degrees of roundness on their propensity for reverse transfer. The experiment was carried out using cyan toner used for a digital color copying machine (Imagio Color 4000) of Ricoh make. The cyan toner has an average degree of roundness of 0.919 and an average particle diameter of 6.8 μm. This toner was fusion-rounded by subjecting it to a high temperature air current and toners having four different average degree of roundness were obtained by varying the temperature and the process time. The reverse transferability of these toners was then measured.

It became evident from the experiment that reverse transferability reduces if the average degree of roundness of the toner is not less than 0.94 and hence the preferred toner particle shape is one in which the degree of roundness is 0.94 or greater (claim 25).

There are two methods for obtaining close-to-spherical toner particles. The first method involves polymerization of a monomer dispersion medium that can be polymerized and another monomer that contains at least a colorant. The second method involves melting, kneading, crushing, and sieving of the toner that contains at least a bonding resin and a colorant and carrying out a rounding process on the obtained toner particles. Both the methods are equally effective and either of them may be chosen taking into consideration the features expected from the machine, the cost factor, etc.

However, using a toner having a high degree of roundness, conventionally, has a drawback. The toner particles tend to scatter due to decreased cohesive force between the toner particles and adhesive force of the toner particles with the photosensitive element. Toner scattering is particularly pronounced when the charge is removed from the non-image portion of the photosensitive element in order to prevent reverse transfer. Hence, conventionally, the method of charge removal could not be used. However, according to the present invention, transfer scattering is suppressed by controlling the electric field at the transfer nip inlet. Hence, a toner having a high degree of roundness can be used without the adverse effect of toner scattering, and a good quality image can be reproduced by suppressing reverse transfer even further.

Figure 20:
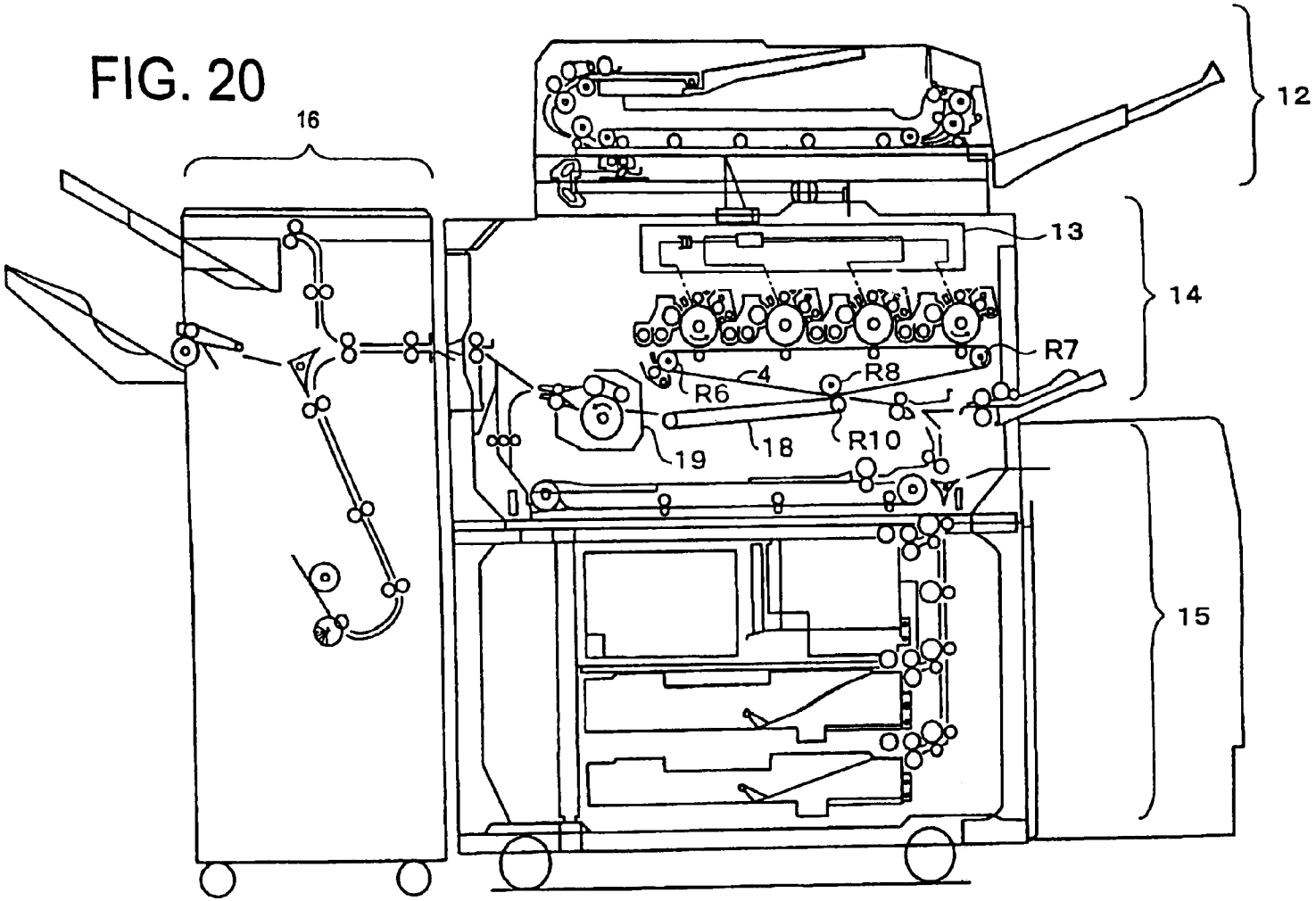
FIG. 20 is a schematic diagram of an internal structure of a tandem-type color image forming apparatus according to a second embodiment of the present invention.
Figure 21:
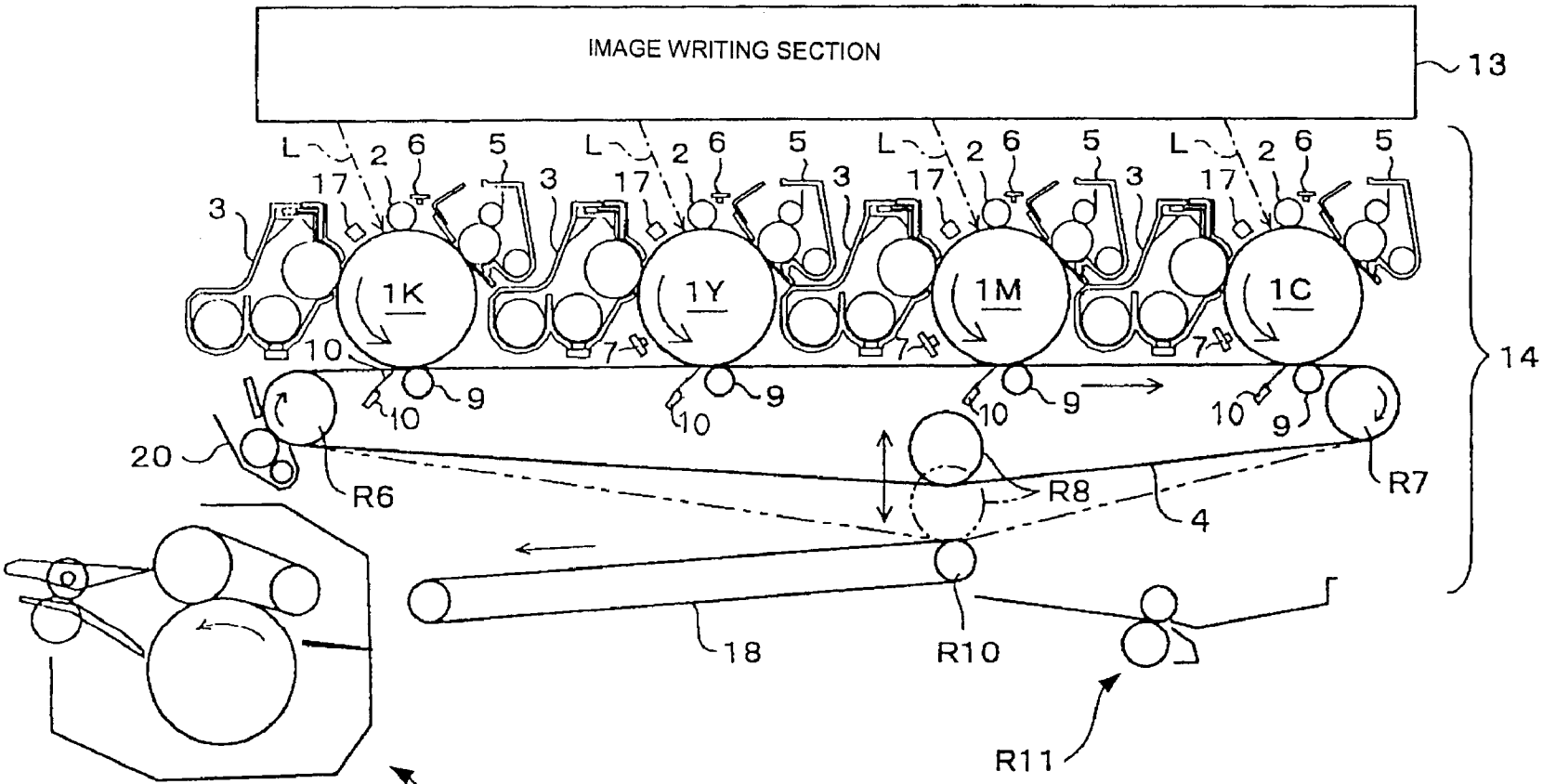
FIGS. 21*a* and 21*b* are schematic diagrams of an image forming portion of the image forming apparatus shown in FIG. 20.
Figure 22:
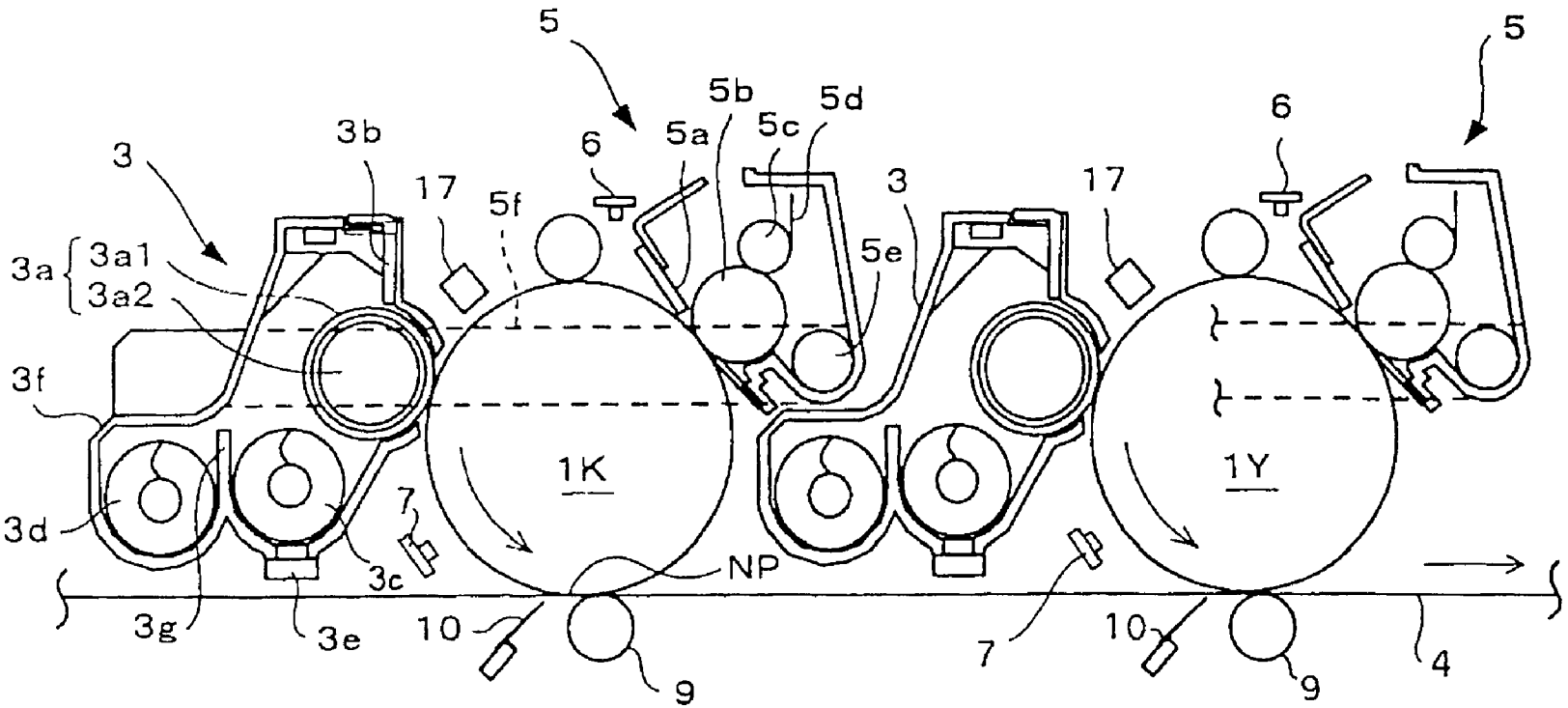
FIG. 22 is an enlarged view of relevant parts of the image forming portion shown in FIG. 21*a*.
Figure 23A:
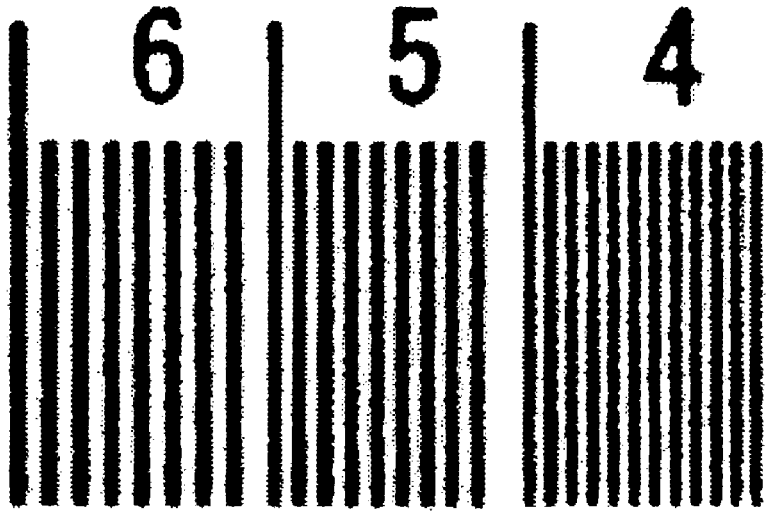
FIG. 23A and FIG. 23B illustrate a result of an experiment to demonstrate a toner scattering on an image of a pre-transfer removal of charge (on the photosensitive element) by light irradiation.
Figure 23B:
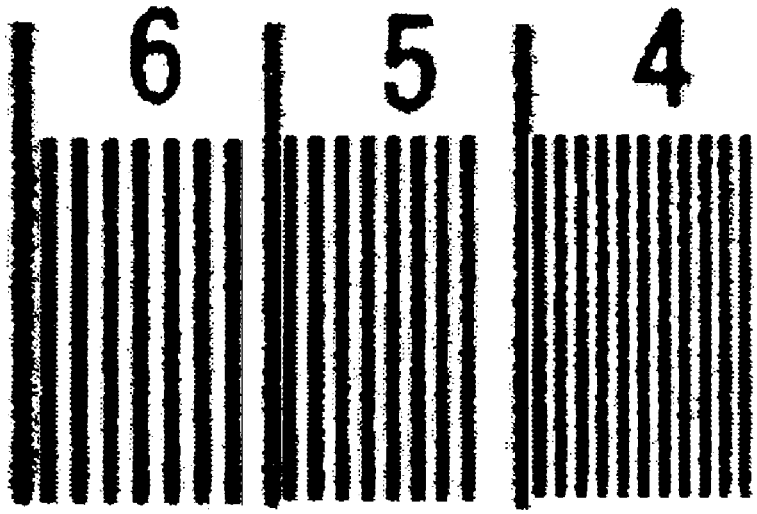

The problem of mixing of colors of spent toner due to reverse transfer during color image formation is also taken care of as reverse transfer can be suppressed by the methods described above. In a tandem-type color image forming apparatus comprising plural photosensitive elements, as shown in FIG. 20 through FIG. 22, each photosensitive element having a developing device 3 for one color. If the toner is depleted in one photosensitive element 1, the spent toner that circulates in the photosensitive element cleaning means 5 is recycled back to the developing device 3 and used again for developing without producing any change in the color or image quality. Thus, the amount of wastage of spent toner can be considerably reduced, which would be eco-friendly, and recycling of spent toner is cost-effective as well.

However, in a single drum image forming apparatus using an intermediate transfer element, as shown in FIG. 1, comprising plural developing devices 3K through 3C for a single photosensitive element, the residual toner of each color after a latent image has been formed on the photosensitive element is cleaned by a single cleaning means 5. Therefore, the toners of different colors tend to collect and mix in the cleaning means 5 thus becoming unfit to be recycled. Consequently, toner recycling is possible only in a tandem-type color image forming apparatus.

Thus, an image forming apparatus that has a structure shown in FIG. 1 can be obtained by using the image transfer methods and the image forming methods described above. In this image forming apparatus, toner scattering during image transfer and reverse transfer are considerably reduced. Therefore, a single drum color image forming apparatus using an intermediate transfer element is realized that can produce a good quality image (claims 26 through 28). Further, an image forming apparatus having a structure shown in FIG. 20 through FIG. 22 can be obtained by using the image transfer methods and the image forming methods described above. In this image forming apparatus, toner scattering during image transfer and reverse transfer are considerably reduced. Therefore, tandem-type color image forming apparatus is realized that can produce a good quality image is realized (claims 29 through 32).

FIG. 1 is a schematic drawing of relevant parts of the image forming apparatus according to a first embodiment of the present invention. This image forming apparatus is a so-called single drum image forming apparatus employing intermediate transfer system and comprises a single photosensitive element, a revolver type developing means 11 in which four types of developing devices for each color, namely 3K, 3M, 3Y, and 3C are used in a switchable manner, and a belt-type intermediate transfer element 4 (intermediate transfer belt).

The image forming apparatus illustrated in FIG. 1 is a modified version of a full color printer (Imagio Color 5100) of Ricoh make and mainly shows the contact area between the photosensitive element 1 and intermediate transfer belt 4 and their vicinity.

The developing unit represented by solid lines indicates that the developing unit is in contact with the photosensitive element 1. In this example, the developing means 3K (for black) constitutes a part of the so-called revolver-type developing means 11. The four developing units, which are identical in their mechanical construction but have toners of different colors (the other three being 3M (for magenta), 3Y (for yellow), and 3C (for cyan)), revolve around the center O and each develops the respective latent image on the photosensitive element 1 into a visible image.

In this example, the intermediate transfer belt 4 is supported by plural rollers R1 through R5 and rotates in the direction indicated by the arrow. A transfer nip NP spans between two rollers R1 and R2 which are provided on the inner surface of the intermediate transfer belt 4. The intermediate transfer belt 4 is held pressed against the photosensitive element 1 by the two rollers R1 and R2.

Between the two rollers R1 and R2 that form the transfer nip NP, the roller R1 (inlet roller), which is located upstream of the direction of rotation of the intermediate transfer belt 4, gets a bias of negative polarity from a bias current source 41 so that the surface potential of the intermediate transfer belt 4 on the transfer nip upstream side is the same polarity as that of the toner. In this example, a counter bias of −1 kilovolts is impressed on the roller R1, thereby preventing distortion of the toner image on the photosensitive element 1 due to unnecessary electric field between the photosensitive element 1 and the intermediate transfer belt 4 before the primary transfer. Consequently, the inlet roller R1 in this example is called a counter-bias roller. This roller R1 in a regular unmodified product is connected to earth (0 volts).

The roller R2 (outlet roller) located downstream of the direction of rotation of the intermediate transfer belt 4 is a transfer bias roller. The roller R2 gets a transfer bias from a transfer bias current source 42. The transfer bias is conducted to the innermost surface of the slightly conductive intermediate transfer belt 4 because of which an electric field is created in the transfer nip NP. In this example a voltage of +1 kilovolt was impressed to pull the toner to the intermediate transfer belt 4. The orientation of the electric field in the vicinity of the nip NP is as explained with reference to FIG. 7 and FIG. 8. In other words, the orientation of the electric field on the transfer nip inlet side is such that the toner is pulled towards the photosensitive element 1, and the orientation of the electric field on the transfer nip outlet side the toner is pulled towards the intermediate transfer belt 4.

In the image forming apparatus shown in FIG. 1 are provided a cleaning means 5 that eliminates the residual toner on the photosensitive element 1, and a charge removing lamp 6 that removes the charge on the surface of the photosensitive element further downstream in the direction of rotation of the photosensitive element from the transfer nip NP.

Further, in this image forming apparatus, in order to prevent reverse transfer, a pre-transfer charge removing lamp (PTL) 7 is provided as a pre-transfer charge removing unit. The pre-transfer charge removing lamp 7 is disposed against the post-developed photosensitive element 1 upstream of the transfer nip NP. Any regular means that removes charge on the photosensitive element may be used as a pre-transfer charge removing lamp (PTL) 7 with a red LED.

In the image forming apparatus shown in FIG. 1 an electrostatic latent image is formed by a not shown writing unit (which uses a laser scanning optical system or a LED array). The developing devices 3M through 3K of the developing means 11 each forms on the photosensitive element leach time the photosensitive element turns, a toner image of the respective color, namely, magenta (M), yellow (Y), cyan (c), and black (K). The toner image of each color is transferred on to the intermediate transfer belt 4 at the transfer nip NP. On the intermediate transfer belt 4, the toner images are superposed to form a full color image. The full color image is then batch transferred on to a recording medium in the form of a sheet S and fixed by a not shown fixing means. In this way a final image is formed. The residual toner of each color on the photosensitive element 1 after the transfer of the toner image is collected by the cleaning means 5.

Also provided in this image forming apparatus is the pre-transfer charge removing lamp (PTL) 7 that removes the charge on the photosensitive element 1 when the toner images are transferred from the photosensitive element 1 on to the intermediate transfer belt 4. Therefore, at the time of transfer of toner images from the photosensitive element 1 on to the intermediate transfer belt 4 (particularly, when transfer of second and subsequent toner images is taking place), the surface potential of the photosensitive element 1 is first reduced by charge removal by the pre-transfer charge removing lamp (PTL) 7 and then the toner images are transferred. There are also provided units (counter bias roller R1 and bias current source 41) for controlling the surface potential of the intermediate transfer belt 4 such that the toner on the photosensitive element upstream of the contact area (transfer nip NP) between the photosensitive element 1 and the intermediate transfer belt 4 does not shift towards the intermediate transfer belt 4. Therefore, the surface potential of the intermediate transfer belt 4 is controlled by applying bias to the counter bias roller R1 such that the toner does not shift towards the intermediate transfer belt 4 upstream of the contact area (transfer nip NP) between the photosensitive element 1 and the intermediate transfer belt 4. Consequently, a good quality image with minimal toner scattering during transfer and negligible reverse transfer can be obtained.

Figure 13:
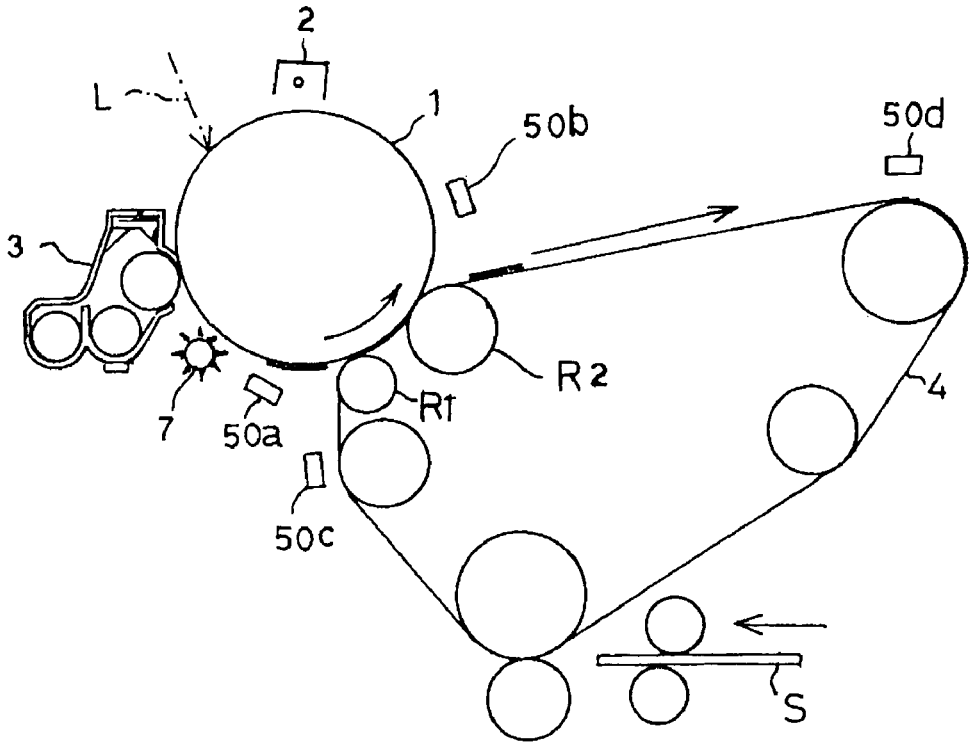
FIG. 13 is a schematic diagram of an experimental image forming apparatus used to verify the effect of the present invention.

In order to verify the effects of the present invention, an image forming apparatus having a structure as shown in FIG. 1 was constructed for the sake of the experiment. In order to observe the effect on the image quality of a beta image and line image, an experimental condition of varying charge potentials was created by varying the potential of the non-image portion on the photosensitive element by employing a pre-transfer charge removing lamp (PTL). To be more specific, the experimental model was constructed as shown in FIG. 13, that is, by placing surface potential measuring probes 50*a*, 50*b*, 50*c*, and 50*d* in order to measure, respectively, the surface potentials of the photosensitive element 1 upstream and downstream of the transfer nip, and the surface potentials of the intermediate transfer belt 4 upstream and downstream of the transfer nip.

Figure 14:
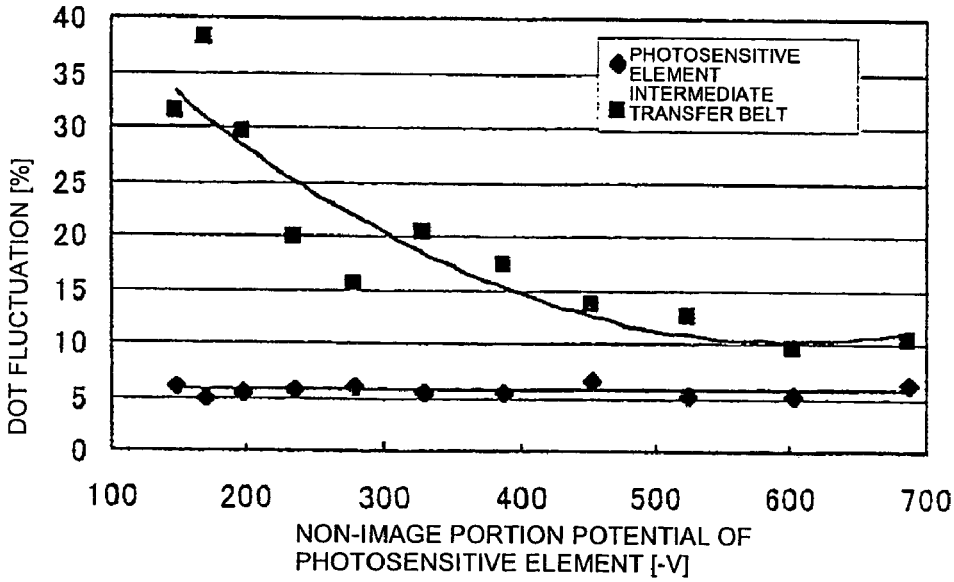
FIG. 14 is a graph of dot fluctuations of images on the photosensitive element and on the intermediate transfer belt when the potential of a non-image portion of the photosensitive element is changed by an optical removal of charge during image transfer.
Figure 15:
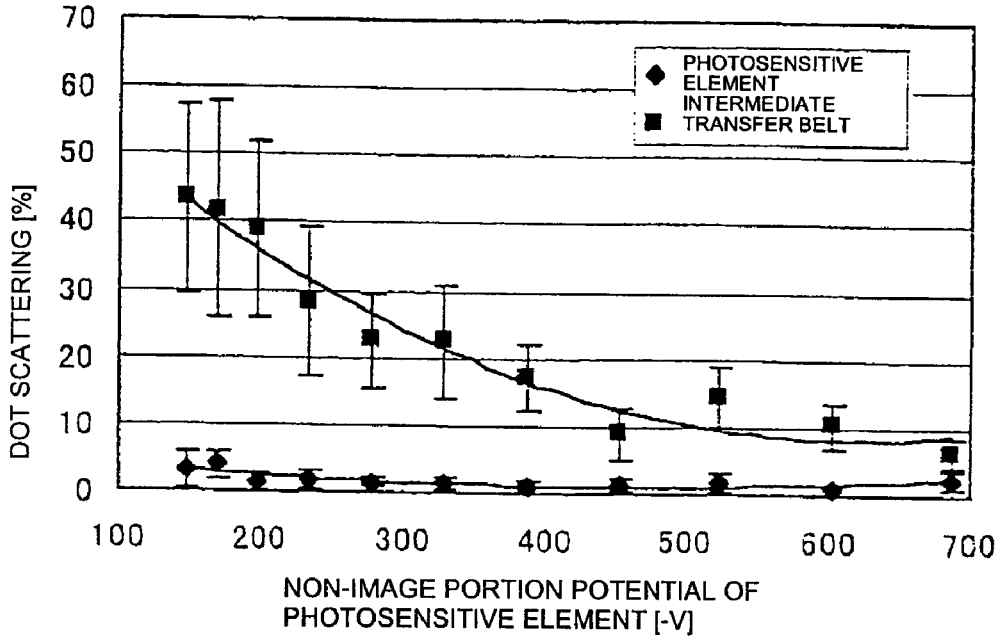
FIG. 15 is a graph of dot scattering of an image on the photosensitive element and an intermediate transfer belt when the potential of a non-image portion of the photosensitive element is changed by an optical removal of charge during image transfer.
Figure 16:
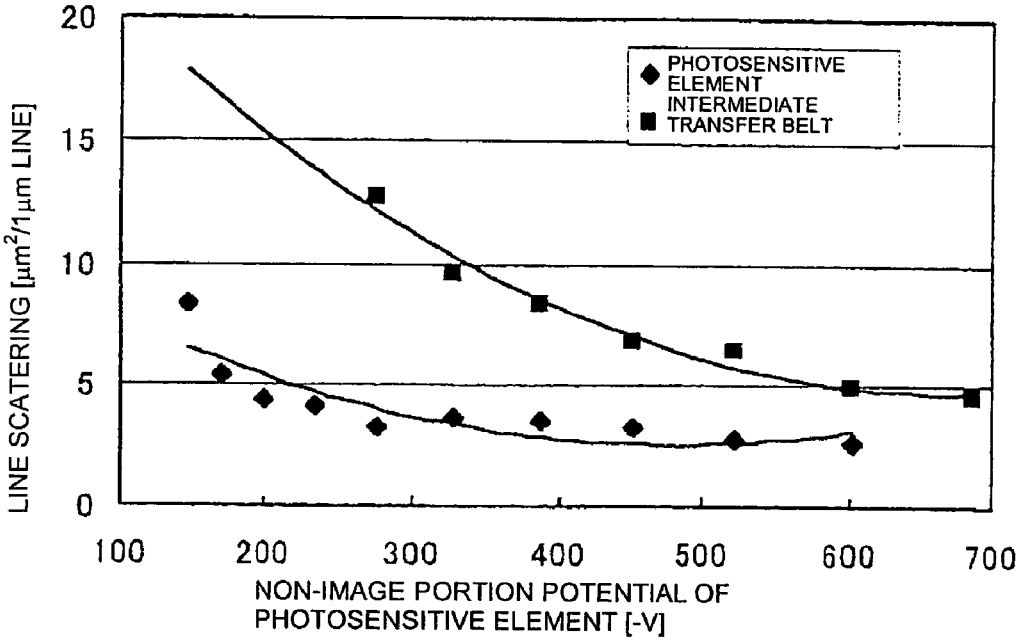
FIG. 16 is a graph of average values of line scattering of images on the photosensitive element and on the intermediate transfer belt when the potential of a non-image portion of the photosensitive element is changed by optical removal of charge during image transfer.

First, observations were made by keeping the image forming conditions for forming the image on the photosensitive element identical but varying the potential of the non-image portion of the photosensitive element 1 by optically removing the charge during the transfer. The results of this experiment are shown in FIG. 14 through FIG. 16 and in Table 2. FIG. 14 is a graph that illustrates dot fluctuation of the images on the photosensitive element and the intermediate transfer belt vis-à-vis the change in the potential in the non-image portion of the photosensitive element. FIG. 15 is a graph that illustrates dot scattering of the images on the photosensitive element and the image transfer belt vis-à-vis the change in the potential in the non-image portion of the photosensitive element. FIG. 16 is a graph that illustrates average values of line scattering of images on the photosensitive element and the intermediate transfer belt vis-à-vis the change in the potential in the non-image portion of the photosensitive element.

The image forming conditions during the measurement were as follows: Amount of toner deposition on the photosensitive element (M/A): 0.73 mg/cm$^2$, toner charge amount Q/M: −17.2 μC/g, malus-coated photosensitive element and intermediate transfer belt, fixed transfer bias: 1100 volts, and potential of the image portion of the photosensitive element: −330 volts.

The inlet roller R1 was made an earth roller (that is, with a bias of 0 volts).

TABLE 2

| Potential of non-image part of photosensitive element | Dot fluctuation (%) | | Dot scattering (%) | |
|---|---|---|---|---|
| | On intermediate transfer belt | On photosensitive element | On intermediate transfer belt | On photosensitive element |
| −688 | 10.3 | 6.2 | 9.8 | 6.3 |
| −602 | 9.4 | 5.0 | 9.0 | 5.0 |
| −523 | 12.5 | 5.1 | 11.6 | 5.4 |
| −451 | 13.5 | 6.5 | 12.3 | 6.6 |
| −386 | 17.3 | 5.4 | 16.3 | 5.3 |
| −329 | 20.3 | 5.4 | 14.5 | 5.5 |
| −278 | 15.4 | 6.0 | 11.9 | 5.8 |
| −235 | 19.8 | 5.7 | 15.1 | 5.6 |
| −198 | 29.4 | 5.5 | 16.2 | 5.9 |
| −169 | 38.0 | 4.9 | 23.6 | 4.7 |
| −147 | 31.3 | 5.8 | 15.0 | 6.3 |

From FIG. 14 through FIG. 16 and Table 2 it can be surmised that when the bias of the inlet roller R1 is provided as an earth roller and its bias is kept 0 volts, the dot fluctuation, dot scatter, and average value of line scatter on the intermediate transfer belt 4 side become pronounced because the potential of the non-image area of the photosensitive element 1 reduces because of pre-transfer charge removal. However, even if pre-transfer charge removal takes place, the effect on the photosensitive element 1 side is negligible and no dot fluctuation or dot scatter takes place.

Figure 17:
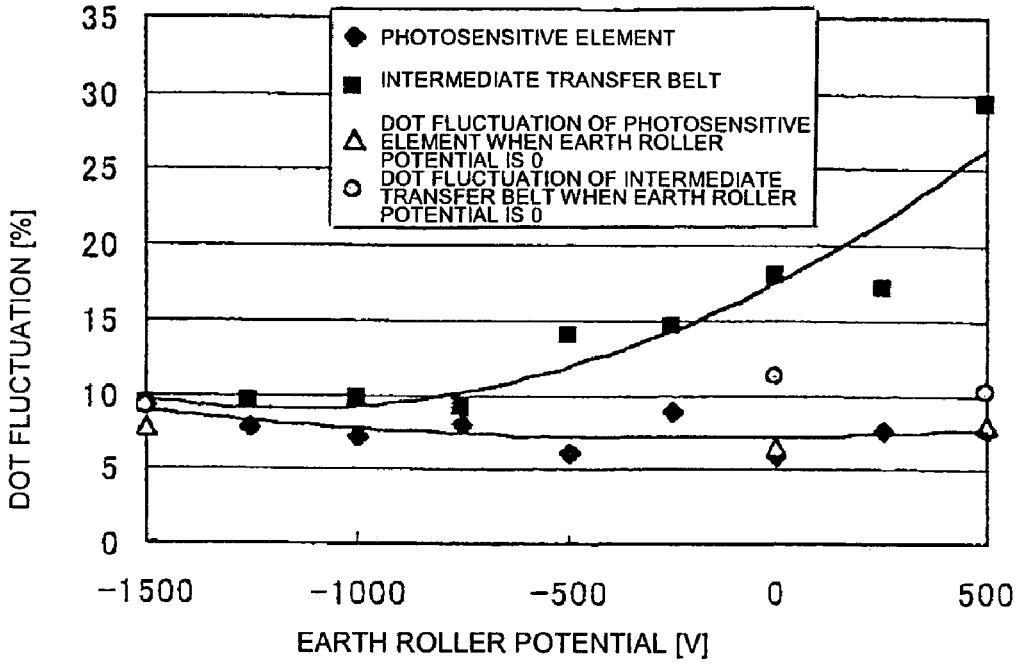
FIG. 17 is a graph of dot fluctuations of images on the photosensitive element and on the intermediate transfer belt when the potential of an earth roller is changed.
Figure 18:
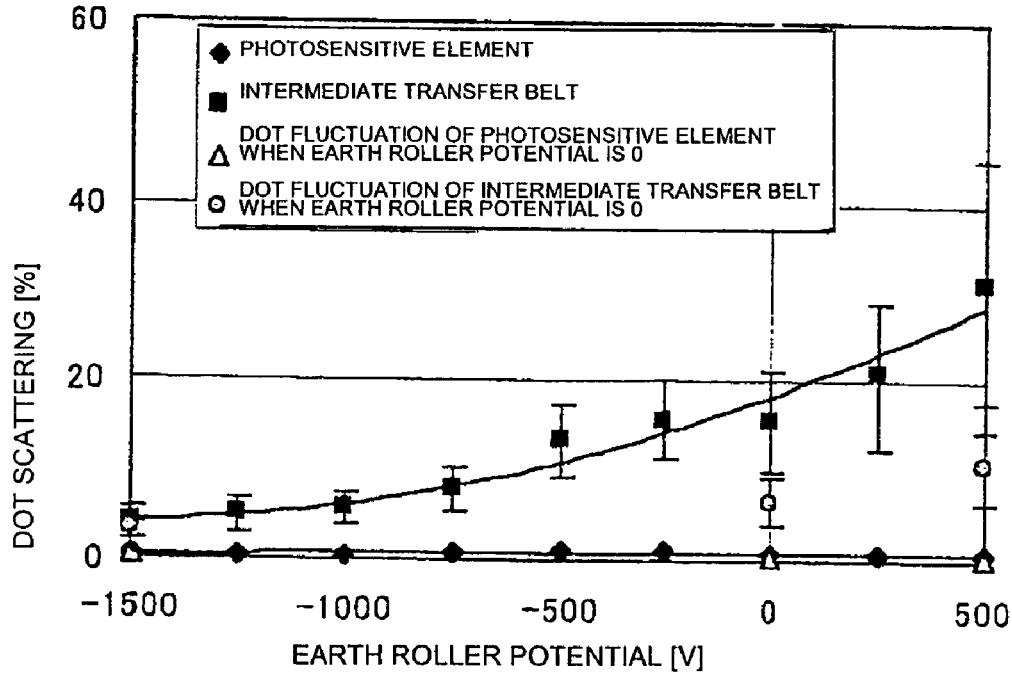
FIG. 18 is a graph of dot scatterings of images on the photosensitive element and on the intermediate transfer belt when the potential of an earth roller is changed.
Figure 19:
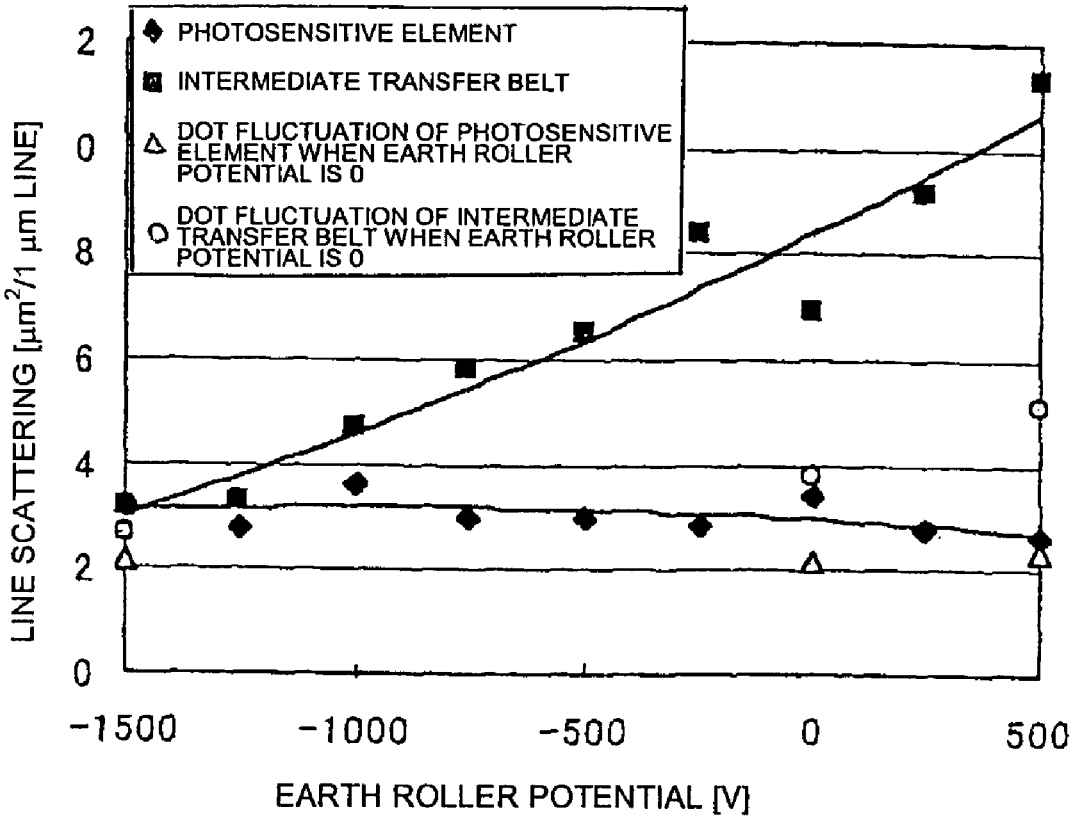
FIG. 19 is a graph of average values of line scattering of images on the photosensitive element and on the intermediate transfer belt when the potential of an earth roller is changed.

Next, in the same apparatus structure, in addition to varying the potential of the non-image area of the photosensitive element by employing the pre-transfer charge removing lamp (PTL) 7, a counter bias was impressed to the roller R1 on the transfer nip inlet side and the effect of this counter bias was observed in the portion where there is no potential difference between the image portion and the non-image portion. The results of these observations are shown in FIG. 17 through FIG. 19 and Table 3. FIG. 17 is a graph that shows dot fluctuation of the images on the photosensitive element and the intermediate transfer belt vis-à-vis a change in the potential of the earth roller. FIG. 18 is a graph that shows dot scattering of the images on the photosensitive element and the intermediate transfer belt vis-à-vis a change in the potential of the earth roller. FIG. 19 is a graph that shows average values of line scattering of images on the photosensitive element and the intermediate transfer belt vis-à-vis a change in the potential of the earth roller.

The image forming conditions during the measurement were as follows: Amount of toner deposition on the photosensitive element (M/A): 0.73 mg/cm$^2$, toner charge amount Q/M: −14.27 μC/g, malus-coated photosensitive element and intermediate transfer belt, fixed transfer bias: 1100 volts, and potential of the image portion of the photosensitive element: −330 volts.

TABLE 3

| Potential of earth roller | Dot fluctuation (%) | | Dot scattering (%) | |
|---|---|---|---|---|
| | On intermediate transfer belt | On photosensitive element | On intermediate transfer belt | On photosensitive element |
| 500 | 29.2 | 7.7 | 31.1 | 0.8 |
| 250 | 17.1 | 7.5 | 20.7 | 0.8 |
| 0 | 17.9 | 6.0 | 15.5 | 0.6 |
| −250 | 14.5 | 8.9 | 15.7 | 0.9 |
| −500 | 14.0 | 6.1 | 13.3 | 0.9 |
| −750 | 9.0 | 8.1 | 7.8 | 0.7 |
| −1000 | 9.7 | 7.2 | 5.6 | 0.4 |
| −1250 | 9.4 | 7.8 | 4.8 | 0.5 |
| −1500 | 9.2 | 9.3 | 4.0 | 0.5 |

From FIG. 17 through FIG. 19, and take 3 it can be surmised that when a counter bias is impressed on the inlet roller (earth roller) R1 which is provided as a counter bias roller, dot fluctuation and dot scattering is reduced. In other words, the orientation of the electric field in the pre-transfer area is directed towards the photosensitive element 1 due to the application of the counter bias. Consequently, the toner is held by the photosensitive element 1 and pre-transfer of the toner is suppressed. Thus, the image deterioration that occurs due to low potential because of pre-transfer charge removal can be reversed by controlling the surface potential of the intermediate transfer belt 4 by application of a counter bias to the roller R1 on the transfer nip inlet side.

A second embodiment of the present invention is explained next with reference to FIG. 20 through FIG. 22.

FIG. 20 is a schematic diagram that shows the internal structure of a tandem color image forming apparatus. The main unit of the image forming apparatus comprises parts that carry out color image formation by a conventionally known plain recording medium copying process, namely, an image reading section 12, an image writing section 13, an image forming section 14, a recording medium feeding section 15, and an ejection tray 16.

FIG. 21 shows an enlarged view of the relevant parts, namely, the image writing section, the image forming section 14, etc, of the color image forming apparatus shown in FIG. 20. FIG. 22 is an enlarged drawing of a photosensitive element and its vicinity.

Figure 21A:
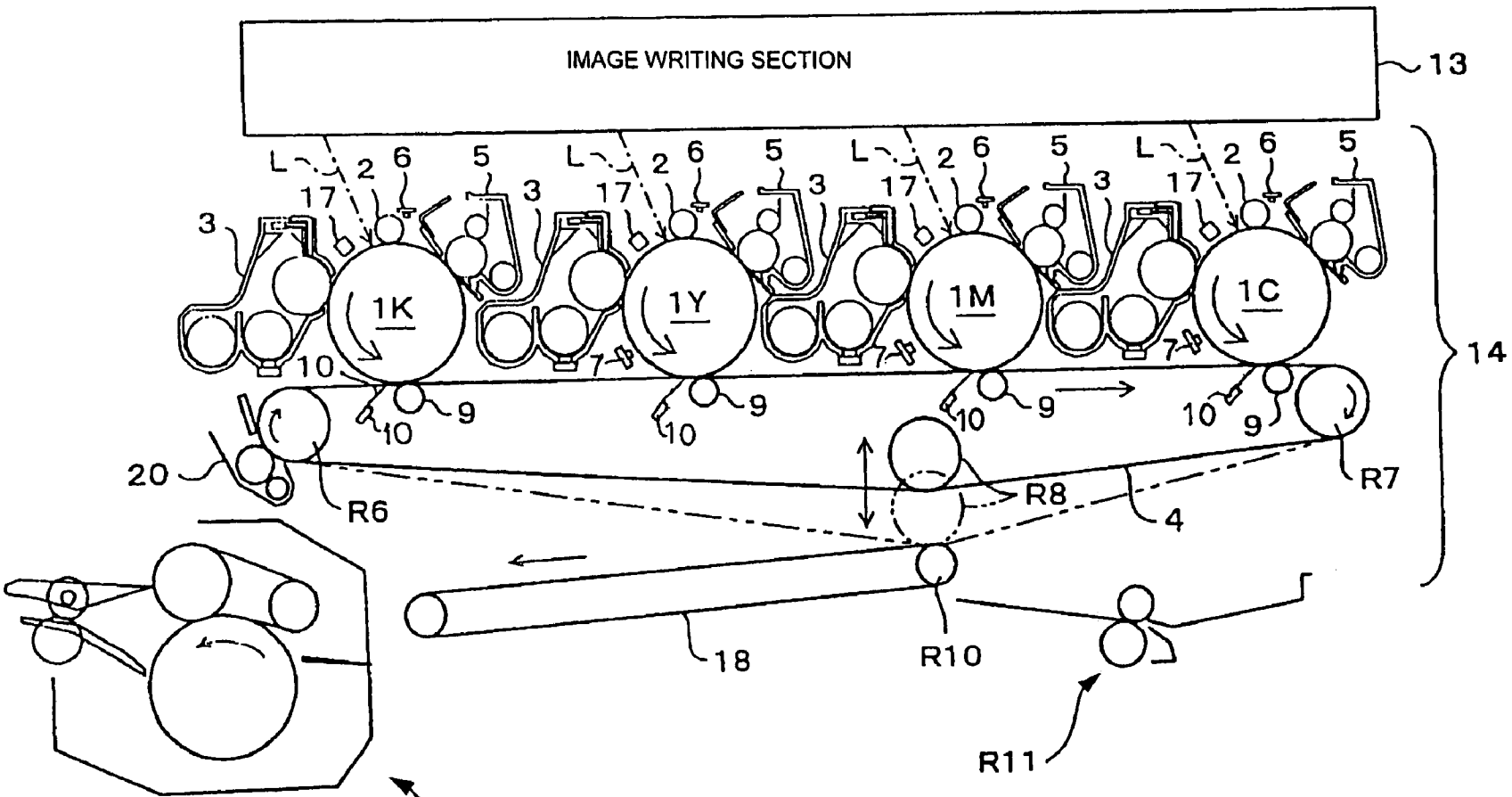
Figure 21B:
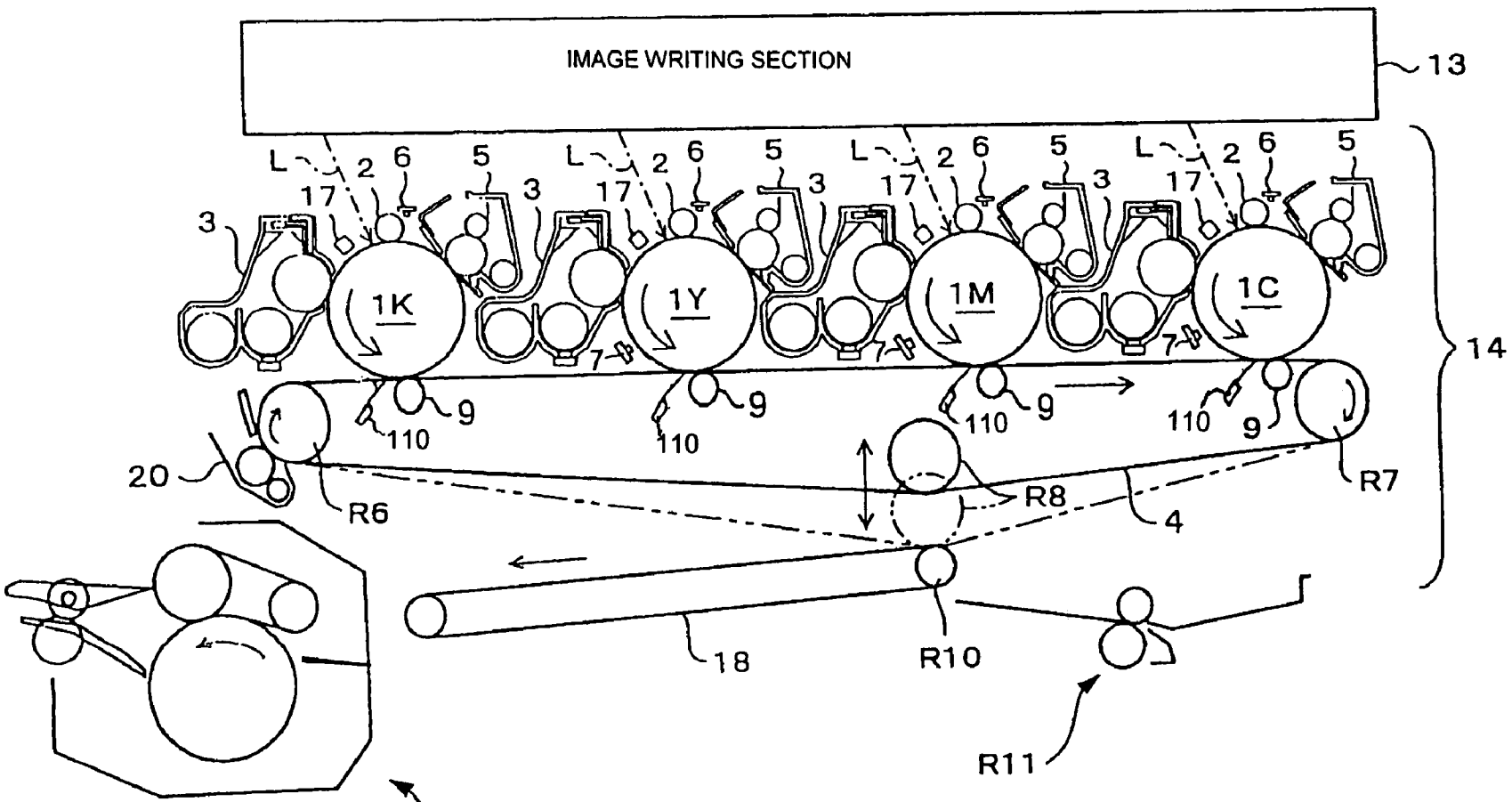

The image formation process is explained next with reference to FIGS. 21*a*, 21*b*, and 22. Image signals are processed by a not shown image processing section and converted, based on the image signals, to black (K), yellow (Y), Magenta (M), and cyan (C) color signals and transmitted to the image writing section 13.

The internal structure of the image writing section 13, which is a latent image forming unit, is a well-known one and hence is not shown diagrammatically. The image writing section 13 comprises a laser scanning optical system or a LED writing system. The laser scanning optical system further comprises a laser light source, a beam deflector such as a revolving polygonal mirror, etc., a scan imaging optical system, and a mirror group. The light emitting diode writing system further comprises an array of light emitting diode, which is an array of plural one-dimensional or two-dimensional light emitting diodes, and an imaging optical system. The image writing section 13 has four optical channels corresponding to the image signal of each color. The image writing section 13 carries out image writing by emitting a writing light L corresponding to each color signal to each of the four photosensitive drums, namely 1K, 1Y, 1M, and 1C, of the image forming section 14.

The image forming section 14 comprises a photosensitive body for each color, namely 1K for black (K), 1Y for yellow (Y), 1M for magenta (M), and 1C for cyan (C). Organic photo conductors (OPC), for instance, may be employed as these photosensitive bodies.

In the vicinity of the photosensitive bodies 1K, 1Y, 1M, and 1C are disposed a charging roller 2, an exposed section which is the section of the photosensitive body exposed to the writing L from the image writing section 13, a developing section provided for each of the photosensitive bodies, a transfer roller 9 for primary transfer, a cleaning means 5, a charge removing unit 6, etc. The developing means 3 employs a two-component magnetic brush developing method.

All the photosensitive elements, namely, 1K, 1Y, 1M, and 1C have a common image forming process. The image forming process of 1K is explained here as a typical case. Before image writing, the surface of the photosensitive element is charged to about −700 volts by the charging roller 2 which is disposed in the direction of rotation further upstream of the exposed portion of the photosensitive element 1K. A conductive rubber roller is used as the charging roller 2 in all the examples of the embodiments. The charging roller 2 is kept in a non-contact fashion at a distance of about 50 μm from the photosensitive element 1K.

An alternating voltage of 1 kilohertz and 2 kilovolts between peaks is impressed on the charging roller 2 and its central value is set at about −800 volts. The photosensitive element 1K is uniformly charged by the charging roller to about −700 volts. The charging unit need not necessarily be restricted to the non-contact type charging roller. A contact-type charger may be used in which a conductive rubber roller is kept in contact with the photosensitive element 1K in order to charge it, or an AC+DC charger may be used, or a DC bias roller may be used which charges the photosensitive element 1K by applying only a DC bias of about −1400 volts. Alternatively, conventional charging methods such as corona charging method in which corotron or scorotron are employed, or brush charging method, etc. may be used. Once the photosensitive elements 1K, 1Y, 1M, and 1C are charged, the image writing section carries out writing and forms latent images respectively on the photosensitive elements 1K, 1Y, 1M, and 1C. Subsequently, the developing device 3 develops the latent images by a developing process.

As shown in FIG. 22, the developing device 3 for each color comprises a developing roller 3*a*, a doctor blade 3*b*, two screws 3*c* and 3*d*, a toner concentration sensor 3*e*, and an outer case 3*f*. The screws 3*c* and 3*d* are disposed in a parallel manner horizontally and are positioned diagonally below the developing roller 3*a*. The screws 3*c* and 3*d* are separated by a separating plate 3*g* provided in the outer case 3*f*.

The front and the back of the separating plate 3*g* are perpendicular to the recording medium surface. There is provided a gap in the separating plate 3*g* both in the front and in the back to allow free circulation of a developer, which comprises a non-magnetic toner and a carrier, between the screws 3*c* and 3*d*. The outer case 3*f* has an opening in the portion that faces the photosensitive element 1K. A part of the developing roller 3*a* is exposed through this opening.

Thus, the outer case is disposed beside the photosensitive element 1K and surrounds the developing roller 3*a*, the screws 3*c* and 3*d*, and the doctor blade 3*b* with slightly more gap above the screw 3*c*.

The developing roller 3*a* comprises a rotatable non-magnetic developing sleeve 3*a*1 and an inner fixed magnet 3*a*2 which produces a magnetic field.

The screws rotate in opposite directions and convey the developer in opposite directions. The toner, which is stirred by the rotation of the screws, is thus always circulating in opposite directions in the two compartments separated by the separating plate 3*g*.

The toner stirred and circulated by the screw 3*c* is supplied to the developing sleeve 3*a*1. The toner is held by a magnetic brush on the surface by the magnetic force of the magnet 3*a*2 and drawn in the direction of rotation of the developing sleeve 3*a*1. An appropriate amount of the toner that is drawn on to the magnetic brush is gathered by doctor blade 3*b* and transferred to the developing section that is disposed against the photosensitive element 1K.

The developer that is left on the magnetic brush after the appropriate amount is taken by the doctor blade 3*b* falls from the magnetic brush on the surface of the developing sleeve 3*a*1 and is returned to the screw 3*c*. From the screw 3*c* the developer moves to the screw 3*d* through the gap on the back of the partition plate 3*g*. From the screw 3*d* the developer returns to the screw 3*a* through the gap on the front of the partition plate 3*g*. This toner is circulated again and supplied to the developing sleeve 3*a*1. The developer that reaches the developing section that is in touch with the photosensitive element 1K which is disposed facing the developing sleeve 3*a*1 converts the latent image on the photosensitive element 1K into a toner image by transferring the toner to the photosensitive element 1K.

An alternating voltage of 2.25 kilohertz and 1 kilovolts between peaks is impressed on the developing sleeve 3*a*1 and its central value is set to −500 volts. The toner movement takes place due to the potential difference between the photosensitive element 1K and the exposed area (charge potential of about −150 volts) arising due to this development bias. The developer that is not used in the conversion of the latent image returns to the external case 3*f*. In the portions where the magnetic force of the magnet 3*a*2 is absent the toner drops from developing sleeve 3*a*1 and collects in the screw 3*c*.

In this way, the developer is stirred by the screws 3*c* and 3*d* and circulated and conveyed to the developing sleeve 3*a*1. Further, in order to maintain a uniform toner concentration, a not shown toner bottle, etc. replenishes the toner when the toner concentration sensor 3*e* detects that, due to repeated image output, the concentration of the toner has reduced.

There are provided light emitting devices in the form of pre-transfer charge removing lamps 7 upstream of the transfer nips where the photosensitive elements 1K, 1Y, 1M, and 1C and the intermediate transfer element 4. The pre-transfer charge removing lamps emit light on the photosensitive element after the development process. There are provided 16 light emitting devices at regular intervals along the axis of the photosensitive element. Each of the light emitting device has a diffusion plate on its surface in order to maintain a uniform amount of light. The light emitting device also has a shielding plate to limit the light only to the required areas. The wavelength of the light emitted by the light emitting devices is set in accordance with the photosensitivity of the photosensitive element and is set slightly shorter than the writing wavelength. In the example shown in FIG. 21, there are no pre-transfer charge removing lamps (LED) 7 in the image forming unit of the first color, as mentioned in claim 24. This is in view of the fact that there is no possibility of reverse transfer when transfer of the first color takes place. Another reason is to cut down the cost. However, in order to be able to commonly use the four photosensitive bodies, the pre-transfer charge removing lamps (LED) 7 may be provided in the image forming unit of the first color. In this case, however, the light emitting device of the image forming unit of the first color should be disabled by means of a not shown controller.

A belt is used as the intermediate transfer element 4. The intermediate transfer belt 4 is suspended by plural rollers R6 through R8 and is disposed in a primary transfer section between a transfer device (for instance, a transfer roller) 9 and the photosensitive elements 1K, 1Y, 1M, and 1C. When the intermediate transfer belt 4 rotates it sequentially passes the photosensitive elements. The toner image of each color formed on each of the photosensitive elements 1K, 1Y, 1M, and 1C is transferred sequentially and superposed on to the same image forming area on the intermediate transfer belt 4 when the intermediate transfer belt 4 passes the transfer nip NP. When the intermediate transfer belt 4 passes the primary transfer section of the last photosensitive element 1C, a full color image is formed on the intermediate transfer belt 4. As a primary transfer method, a transfer charge applying unit in the form of the transfer roller 9, disposed across the intermediate transfer belt 4 facing the photosensitive elements 1K, 1Y, 1M, and 1C, produces a transfer electric field to carry out electrostatic transfer. In the drawing, the transfer electric field is created by applying a voltage of about 1.5 kilovolts is impressed on the transfer roller 9 formed from a conductive urethane rubber (with a hardness of JIS-A40 and a volume resistance of $10^8$ Ωcm.

A Polyvinylidene Flouride (PVDF) belt that has a superior surface smoothness a thickness of 150 μm is used as the intermediate transfer belt 4. As PVDF contains carbon, metal oxides such as tin oxide, etc., its electrical resistance is regulated and it has a volume resistance in the range of $10^{10}$ to $10^{12}$ Ωcm. The portion of the intermediate transfer belt 4 where toner is present has a surface resistance of not less than $10^{12}$ Ω. This characteristic value accounts for a superior transferability. Apart from PVDF, there are other materials that are superior in mechanical durability, such as polyimide, or are low-cost such as polycarbonate (PC), polyethylene (PE), polyethylene terephthalate (PET), polyurethane (PUR), or have good lubrication property such as ethylene tetraflouro ethylene (ETFE) resin, tetra perflouro alkyl vinyl ethyl (PFA) resin, poly tetraflouro ethylene (PTFE) resin, etc., which may be used as per the requirement. Further, the intermediate belt may be made elastic by rendering elasticity in its thickness direction in order to prevent defects in the image such as missing portions, etc. The intermediate transfer belt may be rendered elastic by providing a layer of rubber (with a surface resistance in the range of $10^9$ to $10^{10}$ Ω) having a thickness of a few hundred to few thousand microns on the basic layer of a resin belt.

The transfer roller 9 is provided slightly downstream of the transfer nip NP. Upstream of the transfer nip NP is provided a conductive element 10 that applies a counter bias in order to control the electric field of the transfer nip inlet. In the second embodiment, the conductive element 10 is in the form of a plate (counter bias blade), as explained in FIG. 8. The counter bias blade 10 comprises a 0.5-millimeter-thick conductive PVDF (volume resistance of about 5.times.10.sup.3 .OMEGA.cm and good conductor) glued to a sheet metal frame. The sheet metal frame is fixed to the transfer unit frame. The PVDF plate thrusts out of the sheet metal and because of the flexing makes contact with the intermediate transfer belt 4 and applies a bias. The front edge of the PVDF blade 10 has a curvature R so that the intermediate transfer belt 4 is not damaged. A not shown bias current source applies a negative bias of −1 kilovolts to the blade 10. In an alternative embodiment, blade 10 may be replaced with a brush 110. However, as noted previously, this method also has a drawback in that the bristles may come off.

In the example illustrated in FIG. 21, the intermediate transfer belt 4 is supported by plural rollers R6, R7, and R8. A not shown moving unit controls the movement of the middle roller R8 in such a way that the middle roller comes in contact with or moves away from a roller R10 that supports a conveyer belt 18 on one side. The roller 7 is strengthened in the direction of tension by, for instance, an elastic unit in order to control the tension on the intermediate transfer belt 4.

A secondary transfer section faces the rollers R8 and R10. The secondary transfer section transfers the full color superposed image formed on the intermediate transfer belt 4 on to a recording medium in the form of a recording medium, which is conveyed by a pair of resist rollers R11. The recording medium on which the full color image has been transferred is carried by the conveying belt 18 to the fixing means 19. The image is fixed on the recording medium by the fixing means 19 by application of heat and pressure. The recording medium with the fixed image is ejected to the ejection tray 16.

In FIG. 20 through FIG. 22, after the full color image is transferred on to the recording medium, a intermediate transfer belt cleaning unit (belt cleaning means) 20 provided downstream of the secondary transfer section removes the residual toner on the intermediate transfer belt 4. The primary transfer section then transfers the next image on to the intermediate transfer belt 4.

In the embodiment described above an intermediate transfer belt 4 was used as the intermediate transfer element. However, as shown in FIG. 9 through FIG. 11, a drum type intermediate transfer element (intermediate transfer drum) 8 may also be used according to required accuracy and taking into consideration the layout of the equipment, its size, etc. When a drum type intermediate transfer element is used, as mentioned in claims 17 through 20 and as explained with reference to FIG. 9 through FIG. 11, it is preferable to charge the surface of the intermediate transfer drum 8 with a charging device.

The cleaning means 5 for the photosensitive element is explained next. Each of the photosensitive elements 1K, 1Y, 1M, and 1C has its own cleaning means 5, all of which have identical structures. Hence, as a typical case the cleaning means 5 of the photosensitive element 1K is explained here.

The cleaning means 5 removes the toner that is left behind on the photosensitive element 1K after the primary transfer. The cleaning means 5 comprises an elastic cleaning blade 5*a* and a fur brush 5*b* or a part in which both these components are integrated. In this example, the cleaning means 5 comprises an elastic cleaning blade 5*a* made, for instance, from polyurethane rubber, a fur brush 5*b*, an electric field roller 5*c* that is disposed in contact with the fur brush 5*b*, a scraper 5*d* of the electric field roller 5*c*, and a collecting screw 5*e*, which is disposed in such a way that its length is oriented perpendicular to the recording medium surface shown in FIG. 22. The fur brush 5*b* is conductive. The electric field roller 5*c* is made of metal.

The functioning of the cleaning means 5 is explained next. The fur brush 5*b* that turns in the direction opposite to that of the photosensitive element K1, scrapes the residual toner on the photosensitive element 1K. The electric field roller 5*c* that turns in the direction opposite to that of the fur brush 5*b*, removes the toner from the fur brush 5*b*. The scraper 5*d* cleans the toner from the electric field roller. The electric field roller 5*c* acquires a bias at this stage. The residual toner moves to the fur brush 5*b* from the photosensitive element K1, then on to the electric field roller 5*c* due to electrostatic force and is finally scraped by the scraper 5*d*. The colleting screw 5*e* collects the toner from the scraper 5*d* and returns it to the developing means 3 so that the toner can be reused. Alternatively, the toner may be collected in a not shown spent toner bottle.

The structure in which the toner is returned to the developing means 3 and reused is explained next. The cleaning means 5 and the photosensitive element 1K are positioned in such a way that a conveying duct 5*f* that goes around the collecting screw 5*e* of the cleaning means 5 passes externally with respect to the external case 3*f* which surrounds the screw 3*d* of the developing means 3. This conveying duct 5*f* internally has a conveying screw and the like. The toner scraped by the scraper 5*d* is conveyed inside the conveyer duct and collected in the screw 3*d* of the developing means 3.

In the image forming apparatus according to the present invention, reverse transfer and toner scattering are minimized. Due to this, defect-free good quality image is obtained without compromising on the speed of production. Moreover, the toner can be reused.

As described above, in the image transfer method according to claims 1 to 3, the toner images are transferred from the image bearing element on to the transfer medium (intermediate transfer element) after the surface potential of the image bearing element is controlled by charge removal and the surface potential of the transfer medium (intermediate transfer element) is controlled in such a way that the toner does not shift from the image bearing element to the transfer medium (intermediate transfer element) upstream of the contact area between the image bearing element and the transfer medium (intermediate transfer element) where image transfer takes place. Due to this, toner scattering and the resulting defect in the image as well as reverse transfer can be prevented.

In the image forming method according to claims 4 to 6, the toner images are transferred from the image bearing element on to the transfer medium (intermediate transfer element) after the surface potential of the image bearing element is controlled by charge removal and the surface potential of the transfer medium (intermediate transfer element) is controlled in such a way that the toner does not shift from the image bearing element to the transfer medium (intermediate transfer element) upstream of the contact area between the image bearing element and the transfer medium (intermediate transfer element) where image transfer takes place. Due to this, toner scattering and the resulting defect in the image as well as reverse transfer can be prevented.

In the image forming method according to claims 7 and 8, in addition to the effects of claims 4 to 6, charge removal of the image bearing element can be accomplished in a simple manner and in less space and reverse transfer can be prevented.

In the image forming method according to claims 9 and 10, in addition to the effects of claims 4 to 6, charge removal of the image bearing element can be accomplished without causing optical fatigue in the image bearing element by exposing it to only the required quantity of light and reverse transfer can be prevented.

In the image forming method according to claim 11, in addition to the effects of claim 4 to 10, blotch-free developing can be accomplished and a good image obtained by keeping a sufficient potential difference between the image portion and the non-image portion prior to developing.

In the image forming method according to claim 12, in addition to the effects of claims 4 to 11, occurrence of pre-transfer as well as toner scattering can be prevented.

In the image forming method according to claim 13, in addition to the effects of claim 12, the surface potential of the intermediate transfer element can be easily and precisely controlled by impressing voltage on the conductive element that is disposed in contact with the back of the intermediate transfer element.

In the image forming method according to claim 14, in addition to the effects of claim 13, impairment to the back of the intermediate transfer belt is prevented as far as possible by using a conductive element which is in the form of a roller and is driven at the same speed as the intermediate transfer element (intermediate transfer belt) and impressing a voltage on the conductive element.

In the image forming method according to claim 15, in addition to the effects of claim 13, as the conductive element is in the form of a plate, bias can be impressed from the back of the intermediate transfer belt in minimal space.

In the image forming method according to claim 16, in addition to the effects of claim 13, as the conductive element is the form of a brush, bias can be impressed in minimal space and damage due to friction can be prevented.

In the image forming method according to claim 17, in addition to the effects of claim 12, as the control of the surface potential of the intermediate transfer element is carried out by charging, even for a drum-type image transfer element, transfer scattering can be suppressed by controlling the surface potential of the intermediate transfer element before the transfer nip.

In the image forming method according to claim 18, in addition to the effects of claim 17, since an established charging method in the form of scorotron method is used for charging the surface of the intermediate transfer belt, the potential can be controlled such that it can be set to any desired value.

In the image forming method according to claim 19, in addition to the effects of claim 17, since a contact conductive element such as a roller, etc., is used for impressing voltage on the surface of the intermediate transfer element, production of ozone is suppressed.

In the image forming method according to claim 20, in addition to the effects of claim 17, since a non-contact conductive element is used for impressing voltage on the surface of the intermediate transfer element, charging can be carried out without as far as possible disturbing the toner image that is already present on the surface of the intermediate transfer element.

In the image forming method according to claims 21 to 23, in addition to the effects of any one of claims 4 to 20, when the conditions are such that there is no risk of transfer rate and transfer scattering, etc. since no toner image is present on the image bearing element, reverse transfer can be prevented more emphatically by setting the optimum conditions for preventing reverse transfer.

In the image forming method according to claim 24, in addition to the effects of any one of claims 4 to 23, since an established method is used, the potential can be controlled such that it can be easily set to any desired value.

In the image forming method according to claim 25, in addition to the effects of any one of claims 4 to 24, reverse transfer as well as toner scattering can be suppressed even if a toner with a high degree of roundness, which is prone to scattering, is used.

In the image forming apparatus according to claims 26 to 28, there are provided a charge removing unit that controls the surface potential of the image bearing element by charge removal when the toner image is transferred from the image bearing element on to the transfer medium (intermediate transfer element) and a unit for controlling the surface potential of the transfer medium (intermediate transfer element) in such a way that upstream of the contact area between the image bearing element and the transfer medium (intermediate transfer element) the toner on the image bearing element does not shift to the transfer medium. Consequently, by controlling the surface potential of the image bearing element by charge removal and by controlling the surface potential of the transfer medium (intermediate transfer element), toner scattering and reverse transfer can be prevented and a defect-free good image can be obtained. Thus, a high performance image forming apparatus that accomplishes the dual functions of preventing toner scattering and reverse transfer and that produces high quality image is provided.

In the image forming apparatus according to claims 29 to 31, there are provided charge removing units that each controls the surface potential of the image bearing element by charge removal when the toner image is transferred from the image bearing element on to the single transfer medium (intermediate transfer element), and units for controlling the surface potential of the transfer medium (intermediate transfer element) in such a way that upstream of the contact area between each image bearing element and the transfer medium (intermediate transfer element) the toner on the image bearing element does not shift to the transfer medium. Consequently, by controlling the surface potential of the image bearing element by charge removal and by controlling the surface potential of the transfer medium (intermediate transfer element), toner scattering and reverse transfer can be prevented and a defect-free good image can be obtained. Thus, a high performance image forming apparatus that accomplishes the dual functions of preventing toner scattering and reverse transfer and that produces high quality image is provided.

In the image forming apparatus according to claim 32, mixing of colors is prevented in the cleaning unit by preventing reverse transfer in the primary transfer section. Therefore the toner collected in the cleaning unit can be returned to the developing unit and recycled in a tandem-type image forming apparatus. Thus wastage of material can be reduced by resource conservation.

The present document incorporates by reference the entire contents of Japanese priority document, 2002-276313 filed in Japan on Sep. 20, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming method, comprising:

forming an electrostatic latent image on an image bearing element;

forming a toner image from the electrostatic latent image using toner;

optically neutralizing a surface potential of the image bearing element that carries the toner image so as to create an optically neutralized surface on said image bearing element;

controlling a surface potential of a transfer medium so that the toner is not transferred from the image bearing element to the transfer medium at an upstream of a contact area between the image bearing element and the transfer medium, while controlling a surface potential of a transfer medium so that the toner is transferred from the image bearing element to the transfer medium at a toner nip portion; and transferring a plurality of toner images of different colors from the image bearing element repeatedly to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portions, wherein the surface potential of the transfer medium has same polarity as a toner potential on the image bearing element, and an absolute value of the surface potential of the transfer medium is equal to or greater than an absolute value of the toner potential.

2. The image forming method according to claim 1, wherein the transfer medium is either of a belt and a drum, further comprising:

transferring the superposed toner image on to a recording medium; and forming a final image by fixing the superposed toner image on the recording medium.

3. The image forming method according to claim 1, wherein the surface potential of the image bearing element is neutralized by irradiating a light.

4. The image forming method according to claim 3, wherein the neutralization by the light irradiation is carried out using a light emitting device, wherein the light emitting device includes a light emitting diode, a laser diode, or a xenon lamp, and the surface potential of the image bearing element is controlled by controlling an amount of the neutralization by adjusting an amount of a light emission based on a relation between the amount of a light emission and a current flowing in or a voltage applied to the light emitting device.

5. The image forming method according to claim 1, wherein the surface potential of the image bearing element is neutralized by supplying ions emitted from an ion generating device.

6. The image forming method according to claim 5, wherein the ion generating device is either of a corotron and a scorotron.

7. The image forming method according to claim 1, wherein the charge neutralization takes place after forming the toner images on the image bearing element and before transferring the toner images to the transfer medium.

8. The image forming method according to claim 1, wherein the surface potential of the image bearing element is controlled by applying a potential to a conductive element that is disposed in contact with a back of the transfer medium.

9. The image forming method according to claim 8, wherein a shape of the conductive element is a roller.

10. The image forming method according to claim 8, wherein a shape of the conductive element is a plate.

11. The image forming method according to claim 8, wherein a shape of the conductive element is a brush.

12. The image forming method according to claim 1, wherein the surface potential of the transfer medium is controlled by charging a surface of the transfer medium at the upstream of the contact area.

13. The image forming method according to claim 12, wherein the transfer medium is charged by a scorotron.

14. The image forming method according to claim 12, wherein the transfer medium is charged by applying a voltage to a contact conductive element that rotates at same speed as the transfer medium.

15. The image forming method according to claim 12, wherein the transfer medium is charged by applying a voltage to a non-contact conductive element.

16. The image forming method according to claim 1, wherein a degree of roundness of the toner is equal to or more than 0.94.

17. An image forming method, comprising:

forming an electrostatic latent image on an image bearing element;

forming a toner image from the electrostatic latent image using toner;

optically neutralizing a surface potential of the image bearing element that carries the toner image so as to create an optically neutralized surface on said image bearing element;

controlling a surface potential of a transfer medium so that the toner is not transferred from the image bearing element to the transfer medium at an upstream of a contact area between the image bearing element and the transfer medium, while controlling a surface potential of a transfer medium so that the toner is transferred from the image bearing element to the transfer medium at a toner nip portion; and transferring a plurality of toner images of different colors from the image bearing element repeatedly to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein an amount of charge neutralized from the image bearing element is controlled based on information of the image that is formed on the image bearing element.

18. An image forming method, comprising:

forming an electrostatic latent image on an image bearing element;

forming a toner image from the electrostatic latent image using toner;

optically neutralizing a surface potential of the image bearing element that carries the toner image so as to create an optically neutralized surface on said image bearing element;

controlling a surface potential of a transfer medium so that the toner is not transferred from the image bearing element to the transfer medium at an upstream of a contact area between the image bearing element and the transfer medium, while controlling a surface potential of a transfer medium so that the toner is transferred from the image bearing element to the transfer medium at a toner nip portion; and transferring a plurality of toner images of different colors from the image bearing element repeatedly to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein the surface potential of the transfer medium is controlled based on information of the image that is formed on the image bearing element.

19. An image forming method, comprising:

forming an electrostatic latent image on an image bearing element;

forming a toner image from the electrostatic latent image using toner;

optically neutralizing a surface potential of the image bearing element that carries the toner image so as to create an optically neutralized surface on said image bearing element;

controlling a surface potential of a transfer medium so that the toner is not transferred from the image bearing element to the transfer medium at an upstream of a contact area between the image bearing element and the transfer medium, while controlling a surface potential of a transfer medium so that the toner is transferred from the image bearing element to the transfer medium at a toner nip portion; and transferring a plurality of toner images of different colors from the image bearing element repeatedly to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein a transfer bias potential applied to the transfer medium is controlled based on information of the image that is formed on the image bearing element.

20. An image forming method, comprising:

forming an electrostatic latent image on an image bearing element;

forming a toner image from the electrostatic latent image using toner;

optically neutralizing a surface potential of the image bearing element that carries the toner image so as to create an optically neutralized surface on said image bearing element;

controlling a surface potential of a transfer medium so that the toner is not transferred from the image bearing element to the transfer medium at an upstream of a contact area between the image bearing element and the transfer medium, while controlling a surface potential of a transfer medium so that the toner is transferred from the image bearing element to the transfer medium at a toner nip portion; and transferring a plurality of toner images of different colors from the image bearing element repeatedly to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein neutralization of the surface potential of the image bearing element and control of the surface potential of the transfer medium are executed from the time of transferring a toner image of another color when superposing the toner images.

21. An image forming method, comprising:

forming electrostatic latent images on a plurality of image bearing elements;

forming toner images from the electrostatic latent images using toners of different colors;

optically neutralizing a surface potential of each of the image bearing elements that carry the toner images so as to create an optically neutralized surface on said image bearing element;

controlling a surface potential of a transfer medium so that the toners are not transferred from the image bearing elements to the transfer medium at an upstream of a contact area between the image bearing elements and the transfer medium, while controlling a surface potential of a transfer medium so that the toner is transferred from the image bearing element to the transfer medium at a toner nip portion; and transferring the toner images from the image bearing elements to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein the surface potential of the transfer medium has same polarity as a toner potential on the image bearing element, and an absolute value of the surface potential of the transfer medium is equal to or greater than an absolute value of the toner potential.

22. The image forming method according to claim 21, wherein the transfer medium is either of a belt and a drum, further comprising:

transferring the superposed toner image on to a recording medium; and forming a final image by fixing the superposed toner image on the recording medium.

23. The image forming method according to claim 21, wherein the surface potential of the image bearing element is neutralized by irradiating a light.

24. The image forming method according to claim 23, wherein the neutralization by the light irradiation is carried out using a light emitting device, wherein the light emitting device includes a light emitting diode, a laser diode, or a xenon lamp, and the surface potential of the image bearing element is controlled by controlling an amount of the neutralization by adjusting an amount of a light emission based on a relation between the amount of a light emission and a current flowing in or a voltage applied to the light emitting device.

25. The image forming method according to claim 21, wherein the surface potential of the image bearing element is neutralized by supplying ions emitted from an ion generating device.

26. The image forming method according to claim 25, wherein the ion generating device is either of a corotron and a scorotron.

27. The image forming method according to claim 21, wherein the charge neutralization takes place after forming the toner images on the image bearing element and before transferring the toner images to the transfer medium.

28. The image forming method according to claim 21, wherein the surface potential of the image bearing element is controlled by applying a potential to a conductive element that is disposed in contact with a back of the transfer medium.

29. The image forming method according to claim 28, wherein a shape of the conductive element is a roller.

30. The image forming method according to claim 28, wherein a shape of the conductive element is a plate.

31. The image forming method according to claim 28, wherein a shape of the conductive element is a brush.

32. The image forming method according to claim 21, wherein the surface potential of the transfer medium is controlled by charging a surface of the transfer medium at the upstream of the contact area.

33. The image forming method according to claim 32, wherein the transfer medium is charged by a scorotron.

34. The image forming method according to claim 32, wherein the transfer medium is charged by applying a voltage to a contact conductive element that rotates at same speed as the transfer medium.

35. The image forming method according to claim 32, wherein the transfer medium is charged by applying a voltage to a non-contact conductive element.

36. The image forming method according to claim 21, wherein a degree of roundness of the toner is equal to or more than 0.94.

37. An image forming method, comprising:

forming electrostatic latent images on a plurality of image bearing elements;

forming toner images from the electrostatic latent images using toners of different colors;

optically neutralizing a surface potential of each of the image bearing elements that carry the toner images so as to create an optically neutralized surface on said image bearing element;

controlling a surface potential of a transfer medium so that the toners are not transferred from the image bearing elements to the transfer medium at an upstream of a contact area between the image bearing elements and the transfer medium, while controlling a surface potential of a transfer medium so that the toner is transferred from the image bearing element to the transfer medium at a toner nip portion; and transferring the toner images from the image bearing elements to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein an amount of charge neutralized from the image bearing element is controlled based on information of the image that is formed on the image bearing element.

38. An image forming method, comprising:

forming electrostatic latent images on a plurality of image bearing elements;

forming toner images from the electrostatic latent images using toners of different colors;

optically neutralizing a surface potential of each of the image bearing elements that carry the toner images so as to create an optically neutralized surface on said image bearing element;

controlling a surface potential of a transfer medium so that the toners are not transferred from the image bearing elements to the transfer medium at an upstream of a contact area between the image bearing elements and the transfer medium, while controlling a surface potential of a transfer medium so that the toner is transferred from the image bearing element to the transfer medium at a toner nip portion; and transferring the toner images from the image bearing elements to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein the surface potential of the transfer medium is controlled based on information of the image that is formed on the image bearing element.

39. An image forming method, comprising:

forming electrostatic latent images on a plurality of image bearing elements;

forming toner images from the electrostatic latent images using toners of different colors;

optically neutralizing a surface potential of each of the image bearing elements that carry the toner images so as to create an optically neutralized surface on said image bearing elements;

controlling a surface potential of a transfer medium so that the toners are not transferred from the image bearing elements to the transfer medium at an upstream of a contact area between the image bearing elements and the transfer medium, while controlling a surface potential of a transfer medium so that the toner is transferred from the image bearing element to the transfer medium at a toner nip portion; and transferring the toner images from the image bearing elements to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein a transfer bias potential applied to the transfer medium is controlled based on information of the image that is formed on the image bearing element.

40. An image forming method, comprising:

forming electrostatic latent images on a plurality of image bearing elements; forming toner images from the electrostatic latent images using toners of different colors;

optically neutralizing a surface potential of each of the image bearing elements that carry the toner images so as to create an optically neutralized surface on said image bearing element;

controlling a surface potential of a transfer medium so that the toners are not transferred from the image bearing elements to the transfer medium at an upstream of a contact area between the image bearing elements and the transfer medium, while controlling a surface potential of a transfer medium so that the toner is transferred from the image bearing element to the transfer medium at a toner nip portion; and transferring the toner images from the image bearing elements to the transfer medium to form a superposed toner image on the transfer medium, wherein said step of controlling a surface potential includes applying a negative voltage to said transfer medium before said optically neutralized surface reaches said toner nip portion and applying a positive voltage to said transfer medium after said optically neutralized surface leaves said toner nip portion, wherein neutralization of the surface potential of the image bearing element and control of the surface potential of the transfer medium are executed from the time of transferring a toner image of another color when superposing the toner images.

* * * * *